United States Patent [19]

Maegawa et al.

[11] 4,375,922

[45] Mar. 8, 1983

[54] CHARACTER PRINTING SYSTEM IN ELECTRONIC DATA PROCESSING APPARATUS SUCH AS ELECTRONIC CALCULATORS

[75] Inventors: Toshiyuki Maegawa, Higashiosaka; Yukihiro Yoshida, Ikoma; Satoshi Tominaga, Yamatokoriyama; Toru Izaki, Nara, all of Japan

[73] Assignee: Sharp Kabushiki Kaisha, Osaka, Japan

[21] Appl. No.: 165,339

[22] Filed: Jul. 2, 1980

Related U.S. Application Data

[63] Continuation of Ser. No. 831,400, Sep. 8, 1977, abandoned.

[30] Foreign Application Priority Data

Sep. 16, 1976 [JP] Japan ..... 51-111380

[51] Int. Cl.[3] ..... B41J 5/30

[52] U.S. Cl. ..... 400/70; 400/104; 400/109; 400/110; 400/124; 400/279; 400/284; 400/294; 400/296.1; 400/368; 400/472; 364/900; 364/710

[58] Field of Search ..... 400/70, 74, 103, 104, 400/109, 110, 124, 279, 284, 294, 296.1, 368, 472; 364/710, 900

[56] References Cited

U.S. PATENT DOCUMENTS

| | | | |
|---|---|---|---|
| 2,458,339 | 1/1949 | Buhler et al. | 400/110 |
| 3,015,377 | 1/1962 | Reitfort | 400/74 |
| 3,283,873 | 11/1966 | Robinson | 400/253 |
| 3,346,089 | 10/1967 | Cralle, Jr. et al. | 400/296.1 X |
| 3,436,735 | 4/1969 | Hoiseth | 400/70 X |
| 3,786,480 | 1/1974 | Hatano et al. | 364/710 |
| 3,808,363 | 4/1974 | Kieffer | 400/368 X |
| 3,820,644 | 6/1974 | Yeh | 400/110 |
| 3,844,395 | 10/1974 | Merò et al. | 400/70 X |
| 3,950,734 | 4/1976 | Li | 364/900 |
| 3,980,823 | 9/1976 | Howard | 400/472 X |
| 3,991,671 | 11/1976 | Aizawa et al. | 400/70 X |
| 4,005,390 | 1/1977 | Findley | 400/70 X |
| 4,039,066 | 8/1977 | Quigley | 400/124 |
| 4,045,780 | 8/1977 | Kashio | 400/279 X |

*Primary Examiner*—Ernest T. Wright, Jr.

*Attorney, Agent, or Firm*—Birch, Stewart, Kolasch & Birch

[57] ABSTRACT

A character printing system in an electronic data processing apparatus is provided that is adapted for printing language characters in response to numerical value coded data entered through numeral keys of a keyboard, each character being represented by a respective numerical value coded data of a predetermined convention, wherein said language characters comprises at least two kinds of language characters, such as upper case type alphabet characters and lower case type alphabet characters, or English alphabet characters and Japanese kana characters, or the like, and the keyboard includes language character code entry mode key and language character kind specifying key as well as numeral keys and ordinary commanding keys, and a printer operable responsive to a storage for storing information entered through said keyboard is controlled by a print control responsive to said storage, whereby said printer is controlled to selectively print numerical value coded data in a kind of language characters specified by the information entered through language character kind specifying key. Since at least two kinds of language characters can be selected through mere entry operation by means of the language character kind specifying key, an increased number of language characters can be identified with numerical value coded data of a less number of digits.

10 Claims, 21 Drawing Figures

MEMORY
AM
21
56
100
101
102
103
ADD CT
6
104
MEMORY
5
$X_1$ $X_2$ $X_N$
GATE
20
4a
4
131
123
122
105
SHIFT REGISTER
107
22
125
124
106
120
121
138
51
108
115
TIMING CONTROL
2
114
109
110
111
112
133
116
117
118
52
53
54
AND
127
135

COUNTER
9
10
124
123
122
121
107
138
120
115
114
111
131A
19
F DETECT
32
Q
128
d
c
b
a
11
12
129
CHAR GEN.
7
PRINT CONTROL
8
500
PRINTER
127
501
PAPER SHEET
134
137
136
135
14
15
126
16
17
18
55
116
117
118

CHARACTER PRINTING SYSTEM IN ELECTRONIC DATA PROCESSING APPARATUS SUCH AS ELECTRONIC CALCULATORS

This application is a continuation, of copending application Ser. No. 831,400, filed on Sept. 8, 1977, now abandoned.

BACKGROUND OF THE INVENTION

1. Field of the Invention

The present invention relates to a character printing system in an electronic data processing apparatus. More specifically, the present invention relates to an improvement in a character printing system in an electronic data processing apparatus that is adapted for printing alphanumeric characters in response to numerical value coded data entered through numeral keying input means.

2. Description of the Prior Art

Of late, various data is typically processed by means of an electronic data processing apparatus. For the purpose of entry of such data, an electronic data processing apparatus is provided with a keying input means. For the purpose of entry of a variety of data, a high class electronic data processing apparatus is typically provided with a keying input means which comprises a set of keys allotted for entry of numeral characters, a set of keys allotted for entry of alphabet characters and a set of keys allotted for entry of various symbols and functions. On the other hand, a simple and inexpensive electronic data processing apparatus is often provided with a simple keying input means which comprises merely a set of keys allotted for entry of numeral characters and a set of keys allotted for various symbols and functions, while a set of keys allotted for entry of alphabet characters is dispensed with. The output data thus processed in an electronic data processing apparatus is output in a human readable form, a machine readable form, an electrical signal form, or the like. When the data is to be output in a human readable form, an output means such as a printer, a display or the like is typically utilized. Considering a case where a printer is employed, a high class electronic data processing apparatus is typically provided with a printer which is capable of printing alphabet characters as well as numeral characters and various symbols. However, a simple electronic data processing apparatus is usually provided with a printer which is capable of only numeral characters and various symbols.

A variety of types of electronic calculators are adapted for entry of numerical data by means of a numeral keying input means and adapted for performing an arithmetic operation to provide a result of operation have been proposed and put in practical use. It is often desired that such an electronic calculator be provided with a printer by way of an output means. A typical electronic calculator including a printer comprises a numeral keying input means and a printer capable of printing only numeral characters. However, it is sometimes desired in such an electronic calculator that although a keying input means is adapted for entry of only numeral characters for simplicity of structure a printer is adapted to print alphabet characters as well as numeral characters and various symbols for facility of comprehension of the output data and for providing versatility of indication of the data. To that end, an electronic calculator comprising a printer has been proposed and put in practical use wherein a keying input means is adapted for entry of numerical value coded data concerning alphanumeric characters, apart from ordinary entry of numeral characters, and a printer is adapted for printing alphabet characters as well as numeral characters and various symbols in response to the above described entries. More specifically, a convention is prepared in advance and information concerning the convention is given to the operator wherein for the purpose of entry of numerical value coded data concerning alphanumeric characters a plurality of numerical value codes of say two digits is allotted to each of the alphanumeric characters. Assuming that numerical value coding of two digits is adopted, it will be appreciated that one hundred kinds of numerical value codes are available for identification of alphanumeric characters. It is pointed out that, of these numerical value codes, several codes need be allotted for identification of various symbols and commanding information.

In some applications of such an electronic calculator having a numeral keying input means adapted for entry of numerical value codes as well as ordinary numeral characters and a printer adapted for printing alphanumeric characters in response to such entry, it is further desired that two or more kinds of alphabet characters, such as upper case type alphabet characters and lower case type alphabet characters, or English alphabet characters and Japanese kana characters, or the like can be selectively printed. However, this increases the number of characters being printed and accordingly increases the number of numerical value codes. Thus, it could happen that each numerical value code need be constituted of say three digits rather than two digits as discussed in the above. Such an increased number of characters being printed and an increased number of digits to be allotted for each numerical value code make more complicated the structure of the required circuitry and also make more complicated a manual entering operation by an operator of numerical value codes. Hence, it is desired that there is provided an electronic data processing apparatus having a numeral keying input means adapted for entry of numerical value codes as well as ordinary numeral characters and a printer adapted for printing alphanumeric characters in response to such entry, wherein numerical value codes for two or more kinds of language characters can be entered with a simplified structure and entry operation.

SUMMARY OF THE INVENTION

According to the present invention, there is provided a character printing system in an electronic data processing apparatus that is adapted for printing language characters in response to numerical value coded data entered through numeral keying input means, each character being represented by a respective numerical value coded data of a predetermined convention, wherein said language characters comprises at least two kinds of language characters, such as upper case type alphabet characters and lower case type alphabet characters, or English alphabet characters and Japanese kana characters, or the like, and the keying input means includes language character code entry mode keying input means and language character kind specifying keying input means as well as numeral keying input means and ordinary commanding keying input means, and printing means operable responsive to storage means storing information entered through said keying input means is controlled by print control means responsive to said storage means, whereby said printing means is controlled to selectively print numerical value coded data in a kind of language characters specified by the information entered through language character kind specifying keying input means. Since at least two kinds of language characters can be selected through mere entry operation by means of the language character kind specifying keying input means, an increased number of language characters can be identified with numerical value coded data of a less number of digits. This makes simple the required circuitry and entry operation for an increased number of language characters being printed.

Preferably, the printing means is further adapted to be responsive to the storage means to print the stored information in the ordinary numeral characters. To that end, the keying input means further comprises language/numeral selecting keying input means for selecting print of the stored information in language characters or numeral characters.

Therefore, a principal object of the present invention is to provide an improved character printing system in an electronic data processing apparatus that is adapted for printing language characters in response to numerical value coded data entered through numeral keying input means.

Another object of the present invention is to provide an improved character printing system in an electronic data processing apparatus that is adapted for printing language characters in response to numerical value coded data entered through numeral keying input means, wherein an increased number of language characters can be printed in response to numerical value coded data of a less number of digits.

A further object of the present invention is to provide an improved character printing system in an electronic data processing apparatus that is adapted for printing language characters in response to numerical value coded data entered through numeral keying input means, wherein an increased number of language characters can be printed with a simplified structure and through a simplified entry operation of keying input means.

Still a further object of the present invention is to provide an improved character printing system in an electronic data processing apparatus that is adapted for printing language characters in response to numerical value coded data entered through numeral keying input means, wherein at least two kinds of language characters can be printed in response to numerical value coded data of a less number of digits entered through a simplified entry operation of keying input means.

Still another object of the present invention is to provide an improved character printing system in an electronic data processing apparatus that is adapted for printing alphanumeric characters in response to numerical value coded data entered through numeral keying input means, wherein alphanumeric characters can be selectively printed through a simplified entry operation of the keying input means and wherein an increased number of alphabet characters can be printed in response to numerical value coded data of a less number of digits entered through a simplified entry operation of the keying input means.

These objects and other objects, features, advantages and aspects of the present invention will become more apparent from the following detailed description of the present invention when taken in conjunction with the accompanying drawing.

DESCRIPTION OF THE PREFERRED EMBODIMENTS

General Description

The present invention is directed to an improved character printing system in an electronic data processing apparatus that is adapted for printing language characters in response to numerical value coded data entered through numeral keying input means, wherein at least two kinds of language characters can be printed in response to common numerical value coded data entered through numeral keying input means and language character kind identifying data entered through keying input means provided to that end as to be described subsequently. According to the embodiment to be described, the system is adapted to print selectively a first kind of character including English alphabet characters, numeral characters and other various symbols and a second kind of character including Japanese kana characters, while these two kinds of characters are identified by language character kind identifying data entered through keying input means. Therefore it would be appropriate to describe first of all the convention concerning the numerical value coding employed in the embodiment to be described.

Table 1 shows a convention of numerical value coding employed in the embodiment to be described. The Table includes a repetition of three columns, wherein the left column indicates the common numerical value code including two digits of decimal numbers, the middle column indicates the first kind of characters to be represented by the corresponding numerical value code and the right column indicates the second kind of characters to be represented by the corresponding numerical value code. As seen from Table 1, a common numerical value code is assigned to one of each of two kinds of characters, wherein the first kind of characters include various symbols, numerical characters and upper case type English alphabet characters while the second kind of characters includes the Japanese kana characters. Several specified numerical value codes such as "70~79", "80~89", "90~99" are assigned to a special purpose of the operation of the apparatus, as to be more fully described. Although in the embodiment shown two kinds of language characters are assigned basically to the numeral and upper case type English alphabet characters and Japanese kana characters, respectively, alternatively these two kinds of language characters may be assigned to upper case type English alphabet characters and lower case type English alphabet characters, respectively, English alphabet characters and Russian alphabet characters, respectively, or the like.

Now that the convention of numerical value coding assigned for two kinds of language characters employed in the embodiment shown was described, description will be made of a keying input means or a keyboard to be employed in the embodiment shown for the purpose of entry of various necessary information concerning decimal numerals, and various commands, including the above described language kind identifying information.

Figure 1:
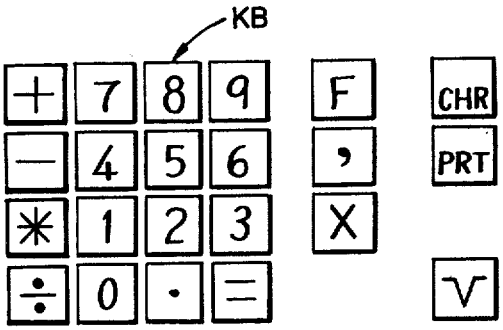
FIG. 1 shows a plan view of a keyboard of an electronic data processing apparatus employing the present invention.

Referring to FIG. 1, a top view of a keyboard KB employed in the embodiment is shown. As understood from the following description, the present invention can be advantageously employed in an electronic calculator. Thus, the keyboard KB (see FIG. 1 and FIG. 2A) to be typically employed in such an electronic calculator comprises ten numeral keys alloted for decimal numerals 0, 1, 2, 3,-9, a decimal point key allotted for a decimal point, and function keys (see FIGS. 1 and 2A) for specifying four arithmetic operations of addition, subtraction, multiplication and division. As understood from the following description, the numeral keys are used to enter the ordinary numerical value and the above described numerical value code in accordance with the above described convention. In the embodiment shown, the numeral keys have been denoted by the respective numeral indications of 0, 1, 2, 3,-9, the decimal point key has been denoted by the ordinary decimal point mark ".", and four arithmetic operation keys for addition, subtraction, multiplication and division have been denoted by the symbols "+", "−", "×" and "÷".

The keyboard KB shown further comprises several additional keys uniquely assigned for the present invention. Such additional keys include a character code entry mode key denoted as "CHR" for enabling a keying entry operation of numerical value code for printing characters, a memory section entry mode key denoted as "X" allotted for enabling an entry operation of data concerning a selected memory section where the data is to be loaded among a plurality of memory sections for storing the entered information, a delimitation key denoted as "," allotted for delimiting a series of keying input operations, a numeral print mode key denoted as "PRT" allotted for enabling print of the data in ordinary numeral characters, a numeral/language character selecting key denoted as "V" allotted for selecting a printing operation of either numeral characters or language characters, and a language kind specifying key denoted as "F" allotted for specifying the kind of language characters to be printed responsive to the stored information. As to be more fully described subsequently, the operation of the numeral print mode key PRT is operatively combined with the operation of the numeral/language character selecting key V subject to operation of the numeral print mode key PRT. More specifically, if the numeral print mode key PRT is operated, the system is brought to a numeral print mode wherein the stored information is printed in the numeral characters, and if the numeral print mode key PRT and the numeral/language character selecting key V are operated, then the system is brought to a language character print mode wherein the stored information is printed in the language characters, which is the same operation after the character code entry mode key CHR (see FIG. 2A) is depressed. However, if the numeral/-language character selecting key V is again depressed, a state is regained in which only the numeral print mode key PRT has been depressed. In other words repetitive operation of the numeral/language character selecting key V is stored in a bistable fashion, which is combined with the operation of the numeral print mode key PRT, such that the operated state of the numeral print mode key PRT and one state of the numeral/language character selecting key V achieves a printing operation of the numeral characters while the operated state of the numeral print mode key PRT and the other state of the numeral/language character selecting key V achieves a printing operation of the language characters. It is pointed out the repetitive operation of the language kind specifying key F is also stored in a bistable fashion which is operatively combined with the operation of the character code entry mode key CHR such that an operated state of the character code entry mode key CHR and one state of the language kind specifying key F achieves a printing operation of the stored information in the first kind of language characters, i.e. in the English alphabet characters, while an operated state of the character code entry mode key CHR and the other operated state of the language kind specifying key F achieves a printing operation of the second kind of language characters, i.e. in Japanese kana letters.

Now that the convention of numerical value coding and the keyboard KB of the embodiment shown were described in the foregoing, for the purpose of providing a general idea of the operation in accordance with the present invention, now description will be made of a few examples of printing operations in accordance with the embodiment shown before a detailed description will be made of the embodiment, inasmuch as it is believed that such general description of the inventive printing operation will facilitate understanding of the following detailed description of the embodiment.

Assuming that the character code entry mode key CHR, the memory section entry mode key X, the numeral key 1, and the delimination key "," are depressed sequentially and the data to be described subsequently had been loaded in the memory sections X1 and X2 (see FIG. 2B), then the printing operation shown in the following examples is performed in accordance with the above described convention.

EXAMPLE 1

| Data in Memory Section X1 |
|---|
| 30 31 32 F 63 62 |
| Printing Operation |
| A B C |

With reference to Table 1 in conjunction with the above described convention, it would be appreciated that the numeral codes 30, 31 and 32 before the language kind specifying key F is operated represent the upper case type alphabet characters A, B, C, respectively, and the numerical value codes 63 and 62 after the language kind specifying key F is operated represent the Japanese kana characters ラ, イ, respectively. Thus, the printing operation as shown is achieved in accordance with the data stored in the memory sections X1 and X2 as shown.

EXAMPLE 2

| Data in Memory Section X1 |
|---|
| 30 31 32 72 5 2 |
| Data in Memory Section X2 |

-continued 1.2345678 5
Printing Operation
A B C 1 2 3 4 5. 6 7 1
X1 X2

The above illustrated printing operation illustrates how the data stored in memory X2 would be printed with the rightmost "1" indication of the "index number". As is apparent, the data in memory X1 commands a shift of the data in X2 to produce 5 digits before the decimal in the printed number thus requiring the scientific notation of 10'.

This example shows a case where the particular numerical value code "72" out of "70" through "79" as briefly described with reference to Table 1 is included in the data loaded in the memory section X1. The term "index number" refers to the power of 10 of the preceeding number, in other words, the superscript in the scientific notation of a number. Since this particular numerical value code "72" is very briefly described with reference to Table 1, now the same is more fully described. The numerical value code "7" combined with any one of numerals 0, 1, 2,-9 such as "72" has been assigned to indicate that the second digit numerical value "2" following the said first digit particular numerical value "7" specifies the memory section X2 of the same serial number as the second digit numerical value "2" and that the data in the memory section X2 thus specified is to be printed in the index number indicating manner and in this case, in a floating decimal point indicating manner. The term "indicating manner" refers to the type of notation with which the number is to be printed, e.g. with index numbers, fixed decimal point rotation or in floating decimal point rotation. The first digit numerical value "5" following the above described numerical value "2" further indicates the number of digits of the integer portion of the mantissa, while the second digit numerical value "2" following the above described numerical value "5" indicates the number of digits less significant than the decimal point. According to such convention, the printing operation is carried out in accordance with the data stored in the memory sections X1 and X2. More specifically, according to the convention provided in Table 1, the numerical value codes 30, 31, 32 correspond to the upper case type alphabet characters, whereupon the memory section X2 is selected and the data in the memory section X2 is printed as "12345.67 1" where "1" is the index number of power of 10.

EXAMPLE 3

Data in Memory Section X1
30 31 32 82 5 2
Data in Memory Section X2
1.2345678 4 (index number)
Printing Operation
A B C 1 2 3 4 5. 6 7
X1 X2

Similarly to the above described description of the numerical value code "72", the numerical value code "82" indicates that the memory section X2 of the same number as the numerical value "2" following the numerical value "8" is to be selected and the data in the memory section X2 thus selected is to be indicated in a fixed decimal point indicating manner. The first digit numeral value "5" following the above described numerical value "2" indicates the number of digits in the integer portion, while the second digit numerical value "2" following the above described numerical value "5" indicates the number of digits less significant than the decimal point. According to such a convention, the data in the memory sections X1 and X2 is printed. More specifically, according to the convention provided in Table 1, the numerical value codes 30, 31, 32 causes the upper case type alphabet characters A, B, C, respectively, to be printed, and the numerical value 8 specifies a further printing operation in a fixed decimal point indicating manner whereby the data in the memory section X2 is printed as "12345.67" following the previous print of "ABC".

EXAMPLE 4

Data in Memory Section X1
30 31 32 92 30
Data in Memory Section X2
3
Printing Operation
A B C A A A This example shows a case where the device is in the language character print mode and the numerical value code "92" is included in the data stored in the memory section X1. The numerical value code "92" is assigned to indicate that the second digit numerical value "2" following the first digit numerical value "9" specifies the memory section X2 of the same numerical value and the data stored in the memory section X2 specifies the number of repetitive printing operations of the character to be represented by the following numerical value code "30". Thus, according to such convention, the upper case type alphabet characters A, B, C, are printed responsive to the numerical value codes 30, 31, 32, whereupon the memory section X2 is selected responsive to the particular numerical value "9" and the following numerical value "2", whereupon the upper case type alphabet character A corresponding to the following numerical value code 30 is repetitively printed by the number of times corresponding to the numerical value "3" stored in the memory section X2.

In the foregoing, several examples were described as if the data in the memory sections X1 and X2 were loaded through entry operation of the keyboard KB. It is pointed out, however, that the same printing operation can be effected in accordance with the programmed data. It is further pointed out that the embodiment shown and described can perform other various operations to be described subsequently, the above described examples being aimed to show only the basic concept of the present invention. With the foregoing description as background information, detailed description will be made of the embodiment of the present invention with reference to FIGS. 2A-C, which show a block diagram of the embodiment.

CIRCUIT CONFIGURATION

Figure 2:
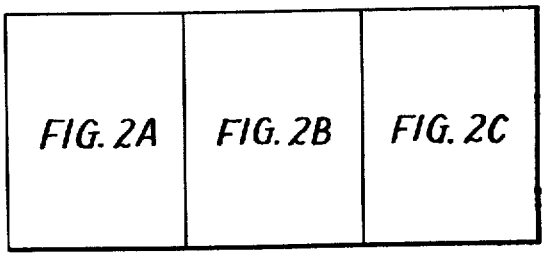
FIG. 2 shows the interconnection of FIGS. 2A–C.
Figure 3:
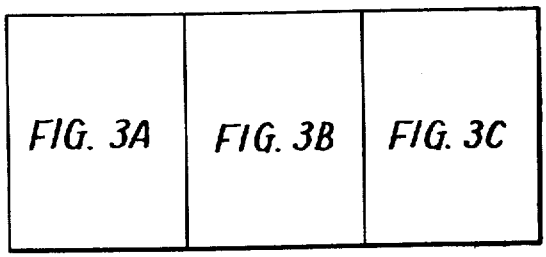
FIG. 3 shows the interconnection of FIGS. 3A–C.
Figure 4:
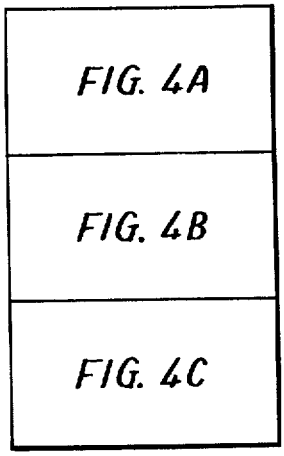
FIG. 4 shows the interconnection of FIGS. 4A–C.
Figure 2A:
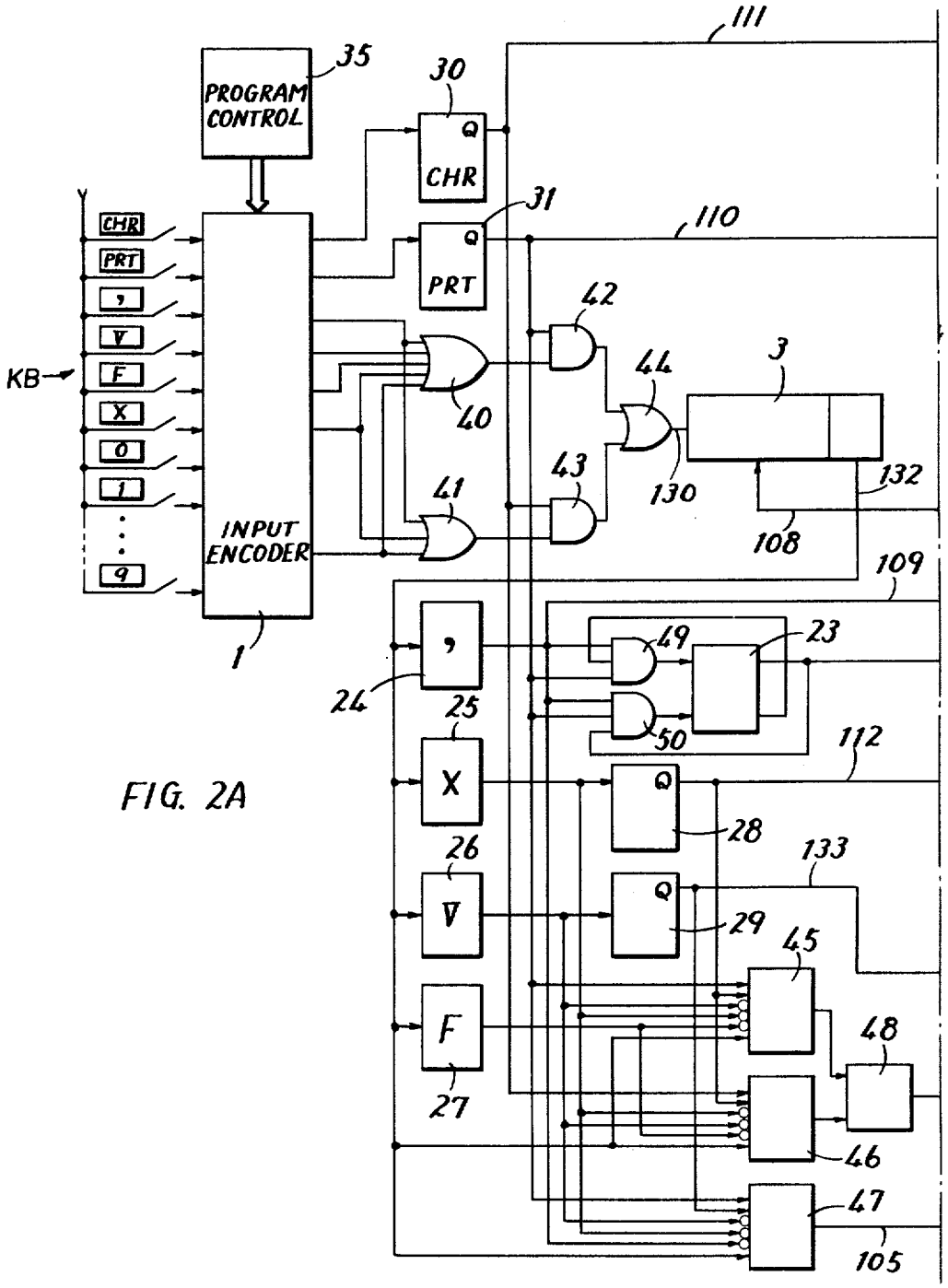
FIGS. 2A–C show a block diagram of one embodiment of the present invention.
Figure 2B:
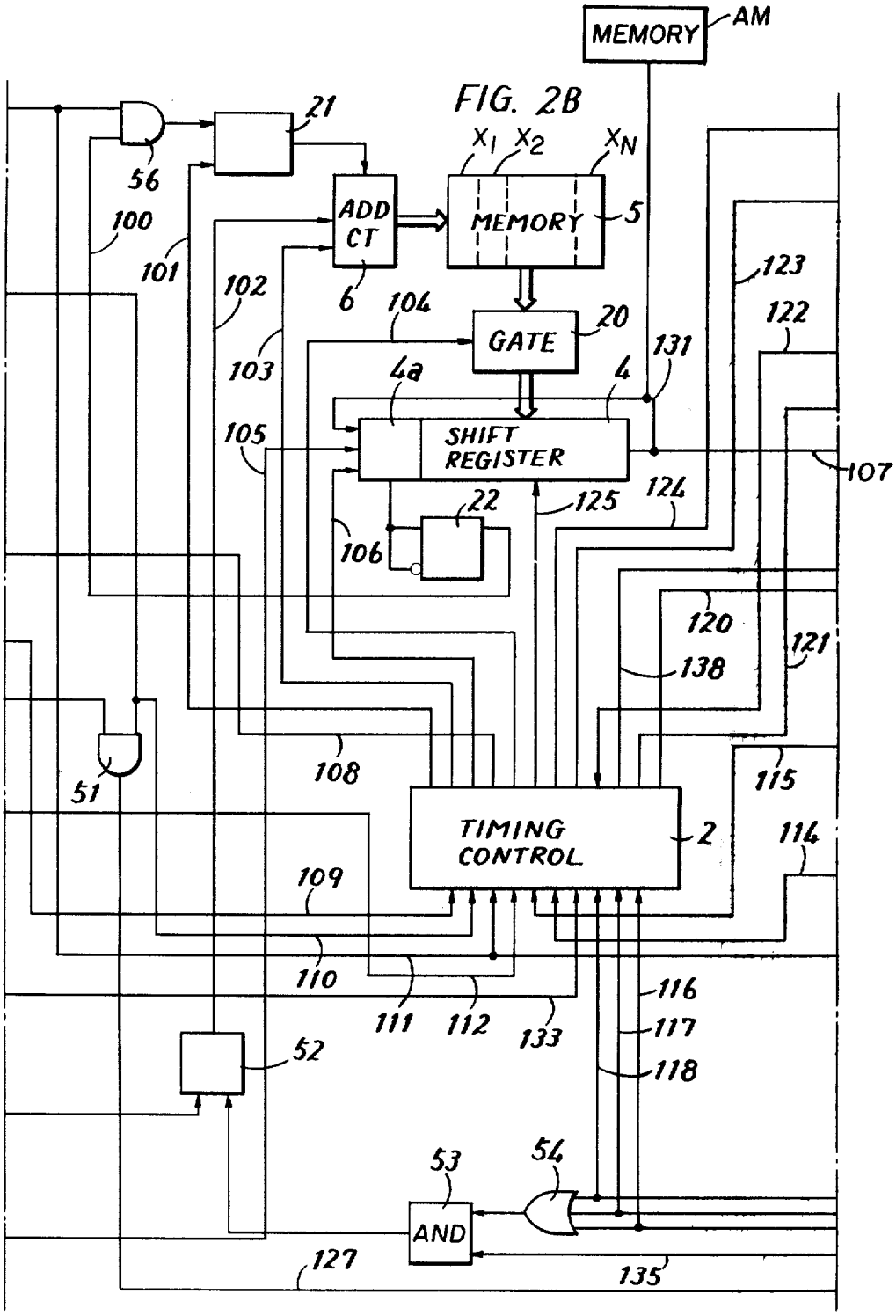
Figure 2C:
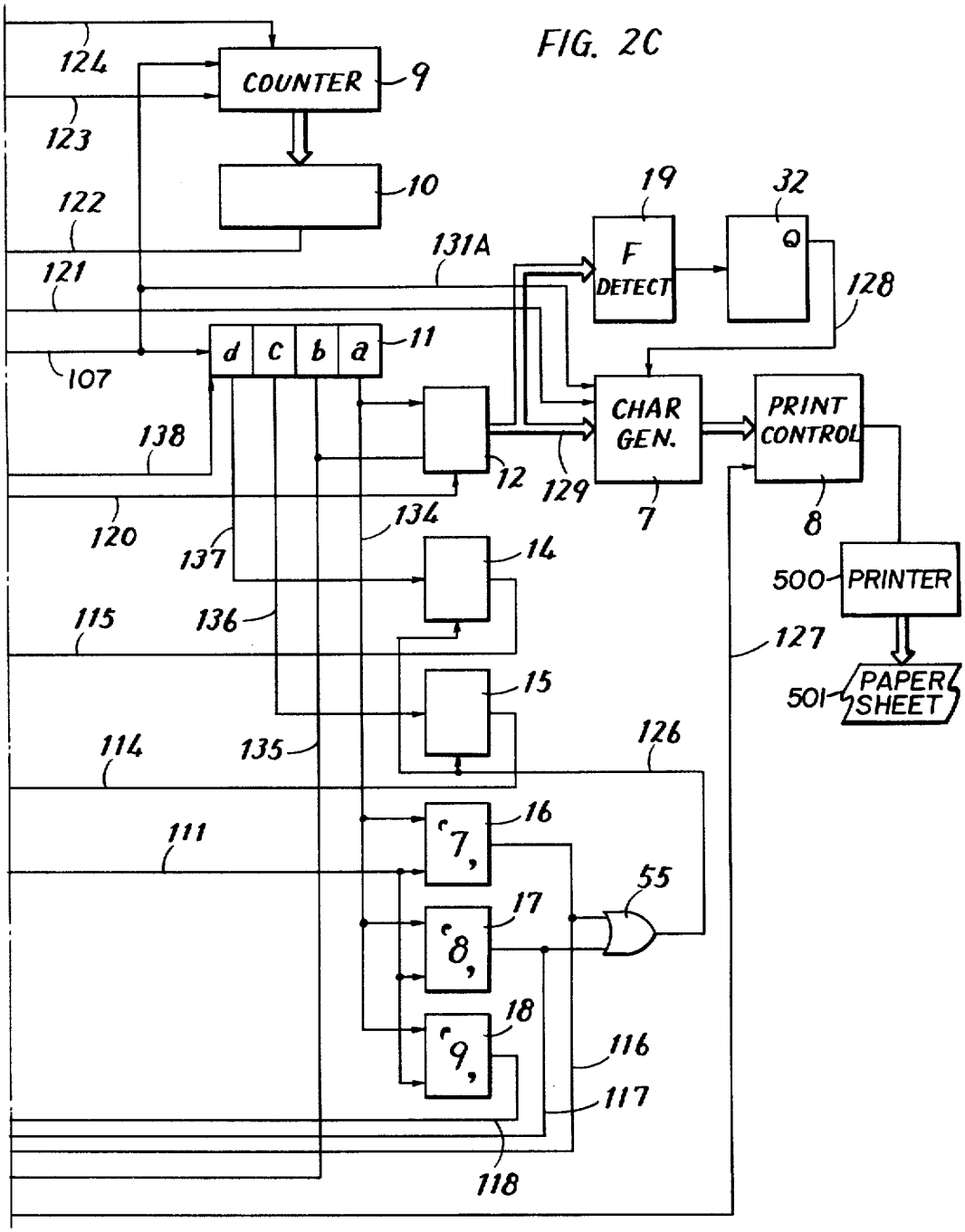

Referring to FIGS. 2A-C, an input encoder 1 is provided to receive the output of the keying operation of the keys in the keyboard KB see FIG. 2A) to generate a coded signal uniquely identifying an operated key in the keyboard KB. The input encoder 1 is also connected to receive the output from a program control 35 to generate a similar code signal representative of the output from the program control 35. Since the program control 35 is structured to provide an output signal of substantially the same type as that of the output from the keyboard KB, description will be made of only a case where the input encoder 1 receives a signal from the keyboard KB.

If and when the character code entry mode key CHR is operated, a signal CHR is obtained from the input encoder 1 and is applied to a flip-flop 30, whereby the flip-flop 30 is set. The set output from the flip-flop 30 is applied to an AND gate 43. Therefore, after the flip-flop 30 is once set, the signal obtainable through operation of the memory section entry mode key X, the numeral keys 0, 1, 2, 3–9, and the delimitation key "," is applied through an OR gate 41, the AND gate 43 and an OR gate 44 and further through a line 130 to an input buffer 3, such that the entered information is stored therein.

On the other hand, if and when the numeral print mode key PRT is operated, a signal PRT is obtained and is applied to a flip-flop 31, whereby the flip-flop 31 is set. A set output from the flip-flop 31 is applied to an AND gate 42. Therefore, after the flip-flop 31 is set, the signal obtainable through operation of the memory section entry mode key X, the numeral/language character selecting key V, the numeral keys 0, 1, 2, 3,–9, the language kind specifying key F, and the delimitation key "," is applied through an OR gate 40, the AND gate 42 and an OR gate 44 and further through the line 130 to the input buffer 3, so that the entered information is stored therein.

The outputs from the above described flip-flops 30 and 31 are applied through lines 111 and 110, respectively, to a timing control 2. The timing control 2 is structured to be responsive to the outputs from these flip-flops 30 and 31 to provide a clock signal in such an input/output operation, which clock signal is applied through a line 108 to the input buffer 3. Therefore, the information loaded in the input buffer 3 is sequentially withdrawn at a line 132.

A gate 24 is provided coupled to the line 132 so as to correspond to the delimitation key ",", such that operation of the delimitation key "," causes the gate 24 to provide the high level output. Similarly, a gate 25 is provided coupled to the line 132 so as to correspond to the memory section entry mode key X such that operation of the memory section entry mode key X causes the gate 25 to provide the high level output. Another gate 26 is provided coupled to the line 132 so as to correspond to the numeral/language character selecting key V, such that operation of the numeral/language character selecting key V causes the gate 26 to provide the high level output. A further gate 27 is provided coupled to the line 132 so as to correspond to the language kind specifying key F, such that operation of the language kind specifying key F causes the gate 27 to provide the high level output. The output from the gate 24 is applied through a line 109 to the timing control 2 and is also applied to AND gates 49 and 50.

If and when a coded signal representative of the delimitation key "," is obtained at the line 132 while the flip-flop 31 has been set and the flip-flop 23 has been reset, the AND gate 49 is enabled, whereby the output from the gate 24 is applied to a flip-flop 23 through the AND gate 49 thereby to set the flip-flop 23. Assuming that the delimitation key "," is again operated in such a situation where the flip-flop 23 has been set, the further signal representative of the delimitation key "," causes the gate 24 to provide the high level output, which is applied through the AND gate 50 as enabled by the set output from the flip-flop 23 to the reset input of the flip-flop 23, whereby the flip-flop 23 is reset.

The set output from the flip-flop 23 is applied through an AND gate 51 and further through a line 127 to a printer conrol 8, thereby to control the printer control 8 such that a printing operation is initiated from the left side of a paper sheet 501. On the other hand, if the flip-flop 23 is reset, the low level output from the flip-flop 23 is applied through the line 127 to the printer control 8, whereby a printing operation is controlled to be initiated from the central portion of a paper sheet 501.

If and when the signal representative of the memory section entry mode key X is obtained in the line 132, the high level output is obtained from the gate 25 thereby to set the flip-flop 28. The set output from the flip-flop 28 is applied through a line 112 to the timing control 2, thereby to indicate that a desired memory section is designated.

If and when the signal representative of the numeral/language character selecting key V is obtained in the line 132, the high level output from the gate 26 is applied to the flip-flop 29, thereby to set the same. The set output from the flip-flop 29 is applied through a line 133 to the timing control 2, thereby to indicate that a language character printing mode is designated.

If and when the signal representative of the language kind specifying key F is obtained at the line 132, the high level output from the gate 27 disables the AND gates 45 and 46, whereby the signal representative of the language kind specifying key F is applied to the OR gate 48, thereby to ensure that the signal representative of the language kind specifying key F inadvertantly entered will prevent the language characters not to be printed from being applied through the AND gates 45 and 46 to the other portions.

From the foregoing description, it would be appreciated that in the case where the flip-flop 30 has been set responsive to the operation of the character code entry mode key CHR and the flip-flop 28 has been set responsive to the operation of the memory section entry mode key X, the data concerning the memory section loaded in the input buffer 3 is applied through the AND gate 46, the OR gates 48 and 52 and further through the line 102 to an address counter 6 and the data concerning the memory section is loaded in the address counter 6 as a function of the clock signal applied from the timing control 2 to the address counter 6.

In the case where the flip-flop 31 has been set responsive to the operation of the numeral print mode key PRT and the flip-flop 28 has been set responsive to the operation of the memory section entry mode key X, the data concerning the memory section loaded in the input buffer 3 is applied through the AND gate 45, the OR gates 48 and 52 and further through the line 102 to the address counter 6 and the data concerning the memory section is loaded in the address counter 6 as a function of the clock signal applied from the timing control 2 to the address counter 6.

If and when the flip-flop 31 has been set responsive to the operation of the numeral print mode key PRT and the flip-flop 29 has been set responsive to the operation of the numeral/language character selecting key V, the data concerning the character code loaded in the input buffer 3 is applied through the AND gate 47 and through a line 105 to a shift register 4 and the data concerning the character code is loaded in the shift register 4 as a function of the clock signal applied from the timing control 2 through a line 106 to the shift register 4.

The line "131" in FIG. 2B is provided as a circulation loop for shift register 4 for recirculating the data from the output of shift register 4 back into the input of the shift register 4 in order that the data being stored therein will not disappear when being read therefrom.

A memory 5 comprises a plurality of memory sections $X_1$, $X_2$,–,$X_n$ that can be addressed or selected responsive to the address counter 6. The data loaded in the memory section $X_n$ of the memory 5 as addressed responsive to the address counter 6 is applied to the shift register 4 through a gate 20 and the said data is loaded in the shift register 4 as a function of the clock signal applied from the timing control 2 through a line 104 to the gate 20.

The most significant digit position 4a of the shift register 4 constitutes a sign bit, such that if the sign is minus the high level is obtained therefrom while if the sign is plus the low level output is obtained therefrom. The output from the sign bit from position 4a is applied to a flip-flop 22, such that if the sign bit from position 4a is minus the flip-flop 22 is set and if the sign bit from position 4a is plus the flip-flop 22 is reset.

The set output from the flip-flop 22 is applied through a line 100 to an AND gate 56, the output of which is applied to a countup circuit 21 which is connected to receive a timing signal through a line 101 from the timing control 2, such that the address counter 6 makes a countup operation responsive to the output from the countup circuit 21, thereby to address the memory section $X_n$. If and when the flip-flop 22 has been reset, the address counter 6 does not make a countup operation. Thus, in a character printing operation after the character code entry mode key CHR is operated and the flip-flop 30 is set, if and when a code allotted for each memory section $X_n$ of the memory 5 is directed and the sign is directed as minus, then the memory sections $X_1$, $X_2$,–,$X_n$ are sequentially accessed and upon detection of the sign as plus, further accessing operation is discontinued. This ensures that the data in a plurality of word sections is printed sequentially.

The above described shift register 4 makes a shifting operation responsive to the clock signal applied from the timing control 2 through a line 125, whereby the data loaded therein is recirculated through a line 131 and is introduced in a four-digit structured register 11 by line 107.

The register 11 is supplied with the clock signal from the timing control 2 through a line 138 to make a two-digit shifting operation. The register 11 is also structured such that the output leads 134, 135, 136 and 137 are withdrawn from the respective digits a, b, c and d, respectively.

The output leads 134 and 135 are connected to a gate 12 which is enabled as a function of the signal applied from the timing control 2 through a line 120, since one character code is represented by the data introduced in the leading two digit positions a and b in the register 11, the output from the gate 12 being applied through a line 129 to a character generator 7.

The numerical value coded signal of two digits applied to the character generator 7 is converted to a dot print code signal, which is applied to the printer control 8, thereby to make a printing operation of the corresponding character as defined in the above described convention in an arrangement of dots. A printer 500 which is capable of printing selectively any desired character among a character font responsive to a coded signal in an arrangement of dots is well known to those skilled in the art.

If and when a printing operation of one character is ended, signals are applied through the lines 125 and 138 from the timing control 2, whereby two-digit shifting operation is effected to achieve a subsequent printing operation.

Gates 16, 17 and 18 are provided to receive the data in the digit position a in the register 11 through the line 134 and to be enabled responsive to the set output from the flip-flop 30 obtainable when the character code entry mode key CHR is operated. The gate 16 is structured to detect the particular code "7" to provide the high level output, the gate 17 is structured to detect the particular code "8" to provide the high level output, and the gate 18 is structured to detect the particular code "9" to provide the high level output. If and when the gate 16 or 17 detects the particular code "7" or "8", the gate output is applied through an AND gate 55 and further through a line 126 to gates 14 and 15. The outputs from the gates 16 and 17 are also applied through lines 116 and 117 to the timing control 2 and further through an OR gate 54 to an AND gate 53. The timing control 2 is responsive to the output from the gate 16 to interrupt the signals at the lines 120 and 138, thereby to disable the gate 12. The AND gate 53 is enabled responsive to the output from the gate 16, whereby the output obtainable from the digit position b of the shift register 11 is applied through the AND gate 53 and the OR gate 52 to the address counter 6.

The gates 14 and 15 are enabled responsive to the output from the gate 16, whereby the data designating the number of digits in the mantissa portion or integer portion, and the portion less significant than the decimal point loaded in the digit positions c and d, respectively, of the shift register 11 is introduced through lines 136 and 137, respectively, and further through gates 14 and 15, respectively, to the timing control 2.

If and when the address counter 6 is loaded with the data in the digit position b of the shift register 11, the memory 5 is selected of the memory section $X_n$ designated by the data in the digit position b, whereby the data in the memory section $X_n$ as designated in the memory 5 is loaded in the shift register 4 through the gate 20. If and when the particular code "7" is detected, the data in the shift register 4 is formulated in an index number indicating format in accordance with the data designating the number of digits in the mantissa portion and the portion less significant than the decimal point introduced in the timing control 2 and data in the shift register 4 is applied through a line 131A to the character generator 7 to effect a printing operation of the data in an index number indicating manner as a function of the signal applied through a line 121 from the timing control 2 to the charactor generator 7.

If and when the particular code "8" is detected by the gate 17, a similar printing operation is effected to print the data in a fixed decimal point indicating manner. If and when the particular code "9" is detected by the gate 18, the output from the gate 18 is applied through the line 118 to the timing control 2 and is also applied through the OR gate 54 to the AND gate 53. The timing control 2 is controlled to interrupt signals at the lines 120 and 138, similarly to the above described case, whereby the gate 12 is disabled and the data in the digit position in the register 11 is loaded in the address counter 6 through the AND gate 53 and the OR gate 52. The memory 5 is selected of the memory section $X_n$ as a function of the data loaded in the address counter 6 and the data in the memory section $X_n$ thus selected is loaded in the shift register 4, while the data in the shift register 4 is loaded in the counter 9 as a function of the signal applied from the timing control 2 through the line 123 to the counter 9. The gate 12 is enabled responsive to the signals obtainable at the lines 120 and 138 from the timing control 2, whereby the numerical value code which had been loaded in the digit positions c and d in the shift register 11 is transferred through the gate 12 to the character generator 7 after the same is two-digit shifted, whereby the corresponding character is printed while the signal applied from the timing control 2 through the line 124 to the counter 9 makes a down count. The above described printing operation is repeated until the value in the counter 9 reaches zero. When the zero state in the counter 9 is detected by the detector 10, the signal applied through the line 122 to the timing control 2 brings the printing operation to a stop. Thus, if and when the particular code "9" is detected by the gate 18, the character corresponding to the numerical value code as designated is repetitively printed by the number of times commensurate with the data in the memory section $X_n$ as designated.

The numerical value code obtainable from the above described gate 12 is also applied to a gate 19 which is structured to detect a language kind specifying code of two digits which is generated responsive to the operation of the language kind specifying key F. If and when the gate 19 detects the above described language kind specifying code of two digits, the high level output obtainable therefrom is applied to a flip-flop 32 to set the same. The set output from the flip-flop 32 is applied through a line 128 to the character generator 7, thereby to control the character generator 7 such that the printer 500 prints the data in either of the first or second language characters as specified by the language kind specifying code. The flip-flop 32 comprises a T type flip-flop which is responsive to each input signal to be reversed of the storing state. The character generator 7 is structured such that the same is responsive to the low level output from the flip-flop 32 to specify the first language characters including upper case type English alphabet characters and is responsive to the high level output from the flip-flop 32 to specify the second language characters including Japanese kana letters.

OPERATION

Now description will be made of the operation of the circuit shown in FIGS. 2A–C. Let it be assumed that the character code entry mode key CHR, the memory section entry mode key X, the numeral key 1, and the delimitation key "," are operated in the order described. Then the signal CHR representative of the character code entry mode key CHR is first obtained from the input encoder 1 and is applied to the flip-flop 30, thereby to set the same. The set output from the flip-flop 30 is applied to the timing control 2 and other logical units. The timing control 2 is responsive to the set output from the flip-flop 30 to provide the clock signal in the line 108 and the AND gate 43 is enabled responsive to the set output from the flip-flop 30. Therefore, any coded signals obtainable thereafter responsive to the operations of the memory section entry mode key X, the numeral key 1 and the delimitation key "," are applied through the OR gate 41, the AND gate 43 and the OR gate 44 to the input buffer 3 and are stored therein.

Since the clock signal is obtained at the line 108 from the timing control 2, the data stored in the input buffer 3 is withdrawn at the output line 132 of the input buffer 3. If and when the signal representative of the memory section entry mode key X is obtained, the gate 25 is enabled and the flip-flop 28 is set. The set output from the flip-flop 28 is applied through the line 112 to the timing control 2, thereby to indicate a memory section entry mode. At the same time the AND gate 46 is enabled. When the numeral key 1 is further operated, the data representative of the numerical value "1" representing the memory section $X_n$ is obtained and is applied to the address counter 6 through the AND gate 46, and the OR gates 48 and 52 and further through the line 102. The timing control 2 is responsive to the indication of the memory section entry mode provided by flip-flop 25 which is provided to the timing control 2 through the line 112 responsive to the set output from the flip-flop 28 to provide a signal in the line 103, thereby to load the data in the address counter 6.

Further operation of the delimitation key "," enables the gate 24 and the output therefrom is applied through the line 109 to the timing control 2. The timing control 2 is responsive to the output from the gate 24 to interrupt the clock signal obtained at the line 108, thereby to bring the operation of the input buffer 3 to a stop. The signal obtainable from the timing control 2 at the line 104 enables the gate 20, whereby the memory 5 is selected of the memory section $X_n$ as designated by the data in the address counter 6 and the data in the selected memory section $X_n$ of the memory 5 is introduced in the shift register 4 through the gate 20. If and when the sign of the data introduced in the shift register 4 is minus, the flip-flop 22 is set, while if the sign of the data introduced in the shift register 4 is plus, the flip-flop 22 is reset.

The shift registers 4 and 11 are supplied with the clock signals through the lines 125 and 138, respectively, from the timing control 2. As a result, the shift register 4 makes a two-digit shifting operation. Although the output line of the shift register 4 is connected to the counter 9 and the character generator 7, the data in the shift register 4 is not transferred thereto, since no signal is obtained at the lines 123 and 121, respectively, from the timing control 2.

In the foregoing, general description was made as to the operation of the FIG. 2 diagram. In the following, therefore, specific description will be made as to each of the above described Examples 1 through 4.

In case of the above described Example 1, the data described previously loaded in the memory X1 of the memory 5 is transferred to the four-digit shift register 11, with the result that the digit positions a, b, c and d of the shift register 11 each store the coded signals representing the entered numerals "3", "0", "3", and "1", respectively, while the gate 12 is enabled as a function of the signal obtainable at the line 120 from the timing control 2. Therefore, the two digit numerical value code as loaded in the digit positions a and b of the shift register 11 is introduced into the character generator 7 and is converted into a print code signal representative of the upper case type alphabet character "A" corresponding to the numerical value code "30", which print code signal is applied to the printer control 8, whereby the alphabet character "A" is printed.

After the above described printing operation is completed, the clock signal is obtained at the lines 125 and 138 from the timing control 2, whereby the data in the shift registers 4 and 11 are two-digit shifted. Thus the following two-digit numerical value code is introduced to the character generator 7 and is converted into a print code signal representative of the upper case type alphabet character "B" corresponding to the numerical value code "31", which is then applied to the printer control 8, whereby the alphabet character "B" is printed. Thereafter, the similar printing operation is repeated.

The code signal obtainable from the gate 12 is also applied to the gate 19 for detecting the language kind specifying code signal entered through operation of the language kind specifying key F. If and when the language kind specifying code signal F is detected by the gate 19, then the high level output is obtained therefrom and is applied to the flip-flop 32 to set the same. The set output of the flip-flop 32 is applied to the character generator 7, thereby to specify a printing operation of the Japanese kana letters. Therefore, after the language kind specifying code signal F is detected, the numerical value code "63" as entered from the gate 12 to the character generator 7 is converted into a print code signal representative of the Japanese kana character "ｱ" corresponding to the numerical value code "63", which is applied to the printer control 8, thereby to cause the printer 500 to print the Japanese kana character "ｱ". Similarly, if and when the numerical value code "62" is introduced to the character generator 7, then the Japanese kana character "ｲ" is printed.

If and when a further language kind specifying code signal F is detected by the gate 19, then the flip-flop 32 is reversed of the storing state, whereby the character generator 7 is controlled to regain the alphabet character printing mode. If and when the sign of the data loaded in the shift register portion 4a is minus, then the flip-flop 22 is set and the set output is applied from the AND gate 56 to the count up circuit 21, whereby the address counter 6 makes a count up operation to designate the following memory section of the memory 5 whereby the data in the said following memory section of the memory 5 is loaded in the shift register 4. The printing operation as described above is sequentially repeated. If and when the sign of the data in the shift register position 4a becomes plus, the flip-flop 22 is reset and the address counter 6 is controlled to stop a counting operation.

Now description will be made of the operation in case of the above described Example 2. Referring back to the previously described Example 2, the data in the memory section X1 of the memory 5 is loaded in the shift register 4. In the same manner as described previously, the data is two-digit shifted from the shift register 4 to the four-shift register 11, while the corresponding printing operation is carried out, i.e. the alphabet characters "A", "B", "C" are sequentially printed responsive to the numerical value codes "30", "31", "32".

If and when the above described particular numerical value code "7" reaches the digit positions b and a of the shift register 11, the said particular code "7" is detected by the gate 16 and the detected output is applied through the OR gate 55 to the gates 14 and 15, thereby to enable the same, and is also applied to the timing control 2, and further through the OR gate 54 to the AND gate 53. The timing control 2 is responsive to the output from the gate 16 to disable the gate 12 and to transfer the address data loaded in the digit position b of the shift register 11 from the AND gate 53 to the address counter 6 through the OR gate 52 and the line 102.

The gates 14 and 15 transfer the data designating the number of digits of the mantissa and the digit portion less significant than the decimal point loaded in the digit positions c and d of the shift register 11 through the lines 136 and 137, respectively, and further through the lines 114 and 115, respectively, to the timing control 2.

The data stored in the shift register 4 is transferred to another memory AM (FIG. 2B). Thereafter, the address counter 6 is loaded with the input data "2" by the signal obtained at the line 103, whereby the data in the memory section X2 of the memory 5 is transferred to the shift register 4 through the gate 20 enabled by the signal at the line 104.

The data loaded in the shift register 4 from the memory section X2 is recirculated through the line 131 as a function of the clock signal obtained at the line 125 from the timing control 2 and is formulated in an index number indicating manner in accordance with the data designating the number of digits of the integer portion and the portion less significant than the decimal point plus the index number as introduced in the timing control 2.

Thereafter the data in the shift register 4 is transferred through the line 131A to the character generator 7 as a function of the signal applied from the timing control 2 through the line 121 to the character generator 7. As a result, the numerical value is printed as "12345. 67 1" in an index number indicating manner, wherein "1" of the final digit position represents the index number.

After the above described printing operation is completed, the data as transferred from the shift register 4 is again introduced and the printing operation is carried out in accordance with the said data.

Now description will be made of the operation in case of the above described Example 3. In this case, a similar operation to that in the case of the Example 2 is carried out in accordance with the data loaded in the shift register 4 from the memory section X1 of the memory 5. However, in this case, the particular numerical value code "8" is detected by the gate 17 and the data concerning the integer portion and the data designating the number of digits of the portion less significant than the decimal point are stored in the digit positions c and d of the shift register 11.

The operation in the case of the above described Example 4 will be described. The data loaded in the shift register 4 from the memory section X1 of the memory 5 is sequentially two-digit shifted from the shift register 4 to the four-digit shift register 11 and a printing operation is carried out such that the upper case alphabet characters "A", "B", "C" are printed sequentially corresponding to the numerical value codes "30", "31", "32", respectively.

If and when the particular numerical value code "9" is shifted to the digit position a of the shift register 11, the code "9" is detected by the gate 18 and the detected output is applied to the timing control 2 and is applied through the OR gate 54 to the AND gate 53. Then, the address data which has been loaded in the digit position b of the shift register 11 from the AND gate 53 is transferred through the OR gate 52 and the line 102 to the address counter 6, while the timing control 2 is responsive to the above described detected output to interrupt the signals at the lines 120 and 138, whereby the gate 12 is disabled, and the address counter 6 is loaded with the address data as a function of the clock signal at the line 103. The signal is also obtained at the line 104 to enable the gate 20, whereby the data "3" in the memory section X2 of the memory 5 is transferred to the shift register 4. Thereafter the signals are obtained at the lines 125 and 123 from the timing control 2 and the data "3" in the shift register 4 is introduced to the counter 9 as a function of these signals.

The shift register 11 makes a 2-digit shifting operation as a function of the signals obtainable at the lines 120 and 138 from the timing control 2, whereby the numerical value code "30" is introduced through the gate 12 to the character generator 7, where the numerical value code signal is converted into a print code signal representative of the alphabet character "A" corresponding to the said numerical value code "30" and the print code signal is applied to the printer control 8, thereby to print the alphabet character "A".

When the above described printing operation is completed, the counter 9 makes a down count operation by one responsive to the signal applied thereto through the line 124 from the timing control 2 and thereafter the same alphabet character "A" is printed. Such a printing operation is repeated until the contents in the counter 9 become zero. If and when the contents in the counter 9 become zero, the count value of zero is detected by the detector 10 and the detected output is applied to the timing control 2 through the line 122, thereby to bring a printing operation to a stop. As a result, the alphabet character "A" is printed three times.

Now description will be made of a case where the numeral print mode key PRT is operated.

If and when the numeral print mode key PRT is operated, the signal PRT is obtained from the input encoder 1 and is applied to the flip-flop 31, thereby to set the same. If and when the memory section entry mode key X and the delimitation key "," are operated, the corresponding code signals are applied through the OR gate 41 to the AND gate 43, and since the flip-flop 31 has been set and accordingly the AND gate 43 has been enabled, the above described code signals are loaded through the OR gate 44 to the input buffer 3. The set output of the flip-flop 31 is applied to the timing control 2, which is responsive to the set output to provide the clock signal through the line 108. Accordingly, the entered code signals are loaded in order in the input buffer 3. The input buffer 3 is responsive to the clock signal to send out the data therein.

Now consider the operation in the case where the numerical print mode key PRT, the memory section entry mode key X, the numeral key 1, the delimitation key ",", the memory section entry mode key X, the numeral key 2, and the delimitation key "," are operated in the order described. When the code signal representative of the memory section entry mode key X is obtained, the gate 25 is enabled and the flip-flop 28 is set. The set output of the flip-flop 28 is applied through the line 112 to the timing control 2, thereby to indicate that the memory section entry mode is designated. At the same time the AND gate 45 is enabled. Thereafter the code signal representative of the numeral key 1 is obtained and is applied through the AND gate 45 and the OR gates 48 and 52 and further through the line 102 to the address counter 6. The timing control 2 is responsive to the set output from the flip-flop 28 to provide the signal at the line 103. Therefore, the address counter 6 is loaded with the said code signal "1". Thereafter the code signal representative of the delimitation key "," is obtained and the gate 24 detects the same, so that the detected output is obtained therefrom and is applied through the line 109 to the timing control 2, thereby to bring the operation of the input buffer 3 to a stop. The signal is also obtained at the line 104 and the gate 20 is enabled. As a result, the data in the memory section X1 of the memory 5 is transferred to the shift register 4.

The AND gate 49 is enabled by the output from the gate 24, whereby the flip-flop 23 is set. The set output of the flip-flop 23 is applied through the AND gate 51 to the printer control 8, thereby to designate the left end tabulation or left shift of the printer with respect to the paper sheet 501 to begin the printing operation.

The shift register 4 makes a shifting operation as a function of the signals obtainable at the lines 125 and 121 from the timing control 2 and the data in the shift register 4 is applied to the character generator 7, whereby a printing operation is initiated with the left end tabulation or left shift. When the printing operation is completed, the clock signal is obtained at the line 108 and the following data is obtained from the input buffer 3. Similarly the address data is loaded in the address counter 6 and the printing operation is carried out as described above. When the second code signal representative of the delimitation key "," is obtained, the AND gate 50 is enabled and the flip-flop 23 is reset. Therefore, the line 127 to the printer control 8 is forced to the low level, whereby the center portion of the paper sheet 501 is designated for undergoing the printing operation and a printing operation is carried out beginning at the center portion of the paper sheet 501.

Now consider the operation of a case where the numeral print mode key PRT, the delimitation key ",", the memory section entry mode key X, the numeral key 1, the delimitation key ",", the memory section entry mode key X, the numeral key 2, and the delimitation key "," are operated. The AND gate 49 is enabled responsive to the code signal representative of the delimitation key "," and as a result the flip-flop 23 is set. The output of the delimitation key "," is applied through the line 109 to the timing control 2. However, since the flip-flop 28 designating the memory section $X_n$ has been reset, the data in the input buffer 3 is transferred to the line 132 as a function of the clock signal obtainable at the line 108.

When the code signal representative of the memory section entry mode key X is obtained, the gate 25 is enabled and the flip-flop 28 is set. The timing control 2 is responsive to the set output from the flip-flop 28 to designate the memory section entry mode. At the same time the AND gate 45 is enabled. Therefore, the subsequent code signal representative of the numeral key 1 is applied through the AND gate 45 and the OR gates 48 and 52 and further through the line 102 to the address counter 6 and the data representative of the numeral value 1 is loaded in the counter 6 in the same manner as described previously.

Then the code signal representative of the delimitation key "," is obtained and therefore the output is obtained from the gate 24, which enables the AND gate 50 and thus resets the flip-flop 23. The output from the gate 24 is applied through the line 109 to the timing control 2, whereby the operation of the input buffer 3 is brought to a stop. The signal is also obtained at the line 104 to enable the gate 20. Therefore, the data in the memory section X1 of the memory 5 is transferred to the shift register 4.

Since the flip-flop 23 is reset, the output obtainable at the line 127 from the AND gate 51 becomes the low level, whereby the printer control 8 is controlled to shift the printing operation to a center portion of a paper sheet 501. The data in the shift register 4 is printed out in the same manner as described previously, although a printing operation is started with the center portion of a paper sheet 501.

When the data is obtained from the input buffer 3 and the code signal representative of the delimitation key "," is detected, the flip-flop 23 is set, whereby a printing operation is carried out thereafter at the left side of the paper sheet 501.

Now consider the operation in the case where the numeral print mode key PRT, the numeral/language character selecting key V, the numeral key 3, the numeral key 0, the numeral key 3, the numeral key 1, the language kind specifying key F, the numeral key 6, the numeral key 3, the numeral/language character selecting key V, and the delimitation key "," are operated in the order described. When the code signal representative of the numeral/language character selecting key V is obtained, the gate 26 is enabled and the flip-flop 29 is set. The set output from the flip-flop 29 is applied to the timing control 2 through the line 133, thereby to indicate that a printing operation of the language characters is selected. At the same time the AND gate 47 is enabled responsive to the set output of the flip-flop 29. Accordingly, the code signals representative of the numeral keys 1, 2, . . . are applied through the AND gate 47 and through the line 105 to the shift register 4 and are loaded in the shift register 4 as a function of the clock signal obtained at the line 106 from the timing control 2.

Now the code signal representative of the numeral/-language character selecting key V is obtained, the gate 26 is enabled and the flip-flop 29 is reset. It is pointed out that the flip-flop 29 comprises a T type flip-flop. Since the flip-flop 29 is reset, the clock signal obtained at the line 108 from the timing control 2 is discontinued, whereby the operation of the input buffer 3 is brought to a stop.

Thereafter the clock signals are obtained at the lines 125, 138 and 120 from the timing control 2 and the data in the shift register 4 is two-digit shifted to the shift register 11 and the two-digit numerical value code is introduced through the gate 12 to the character generator 7. The two-digit numerical value code is converted in the character generator 7 into a print code signal which is then applied to the printer control 8. Therefore the upper case type alphabet characters A and B are printed and the printing operation is changed from the alphabet characters to the Japanese kana letters responsive to the language kind specifying code signal respresentative of the language kind specifying key F, whereupon the Japanese kana character " ｱ " is printed.

When the printing operation is completed, the clock signal is obtained at the line 108 from the timing control 2, whereby the input buffer 3 becomes operative and the subsequent printing operation is supposed to be carried out. However, in the Example under discussion, the code signal representative of the delimitation key "," is obtained, whereupon no data is obtained any more and the operation is terminated.

TIMING CONTROL

Figure 3A:
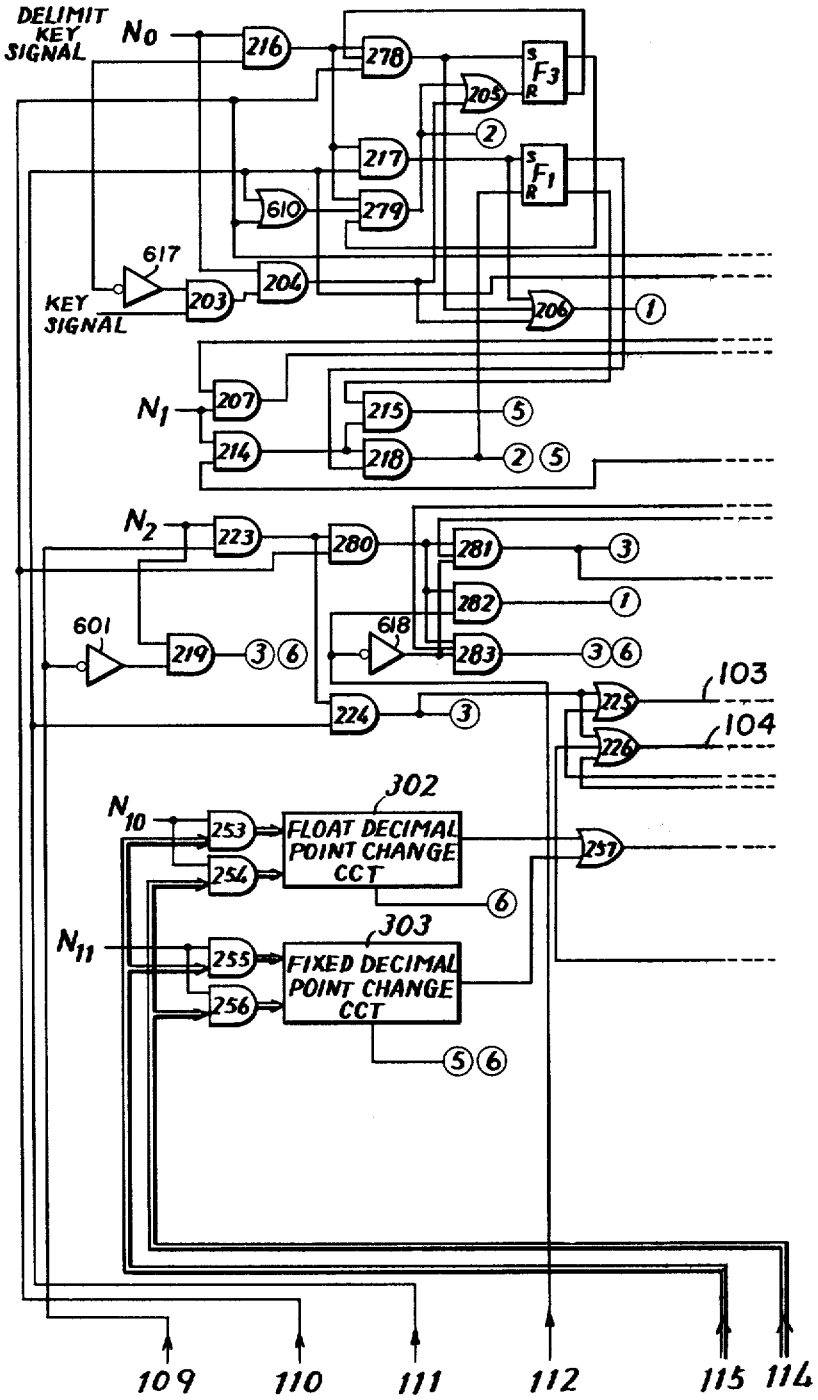
FIGS. 3A–C form a block diagram of the timing control in the FIG. 2 embodiment.
Figure 3B:
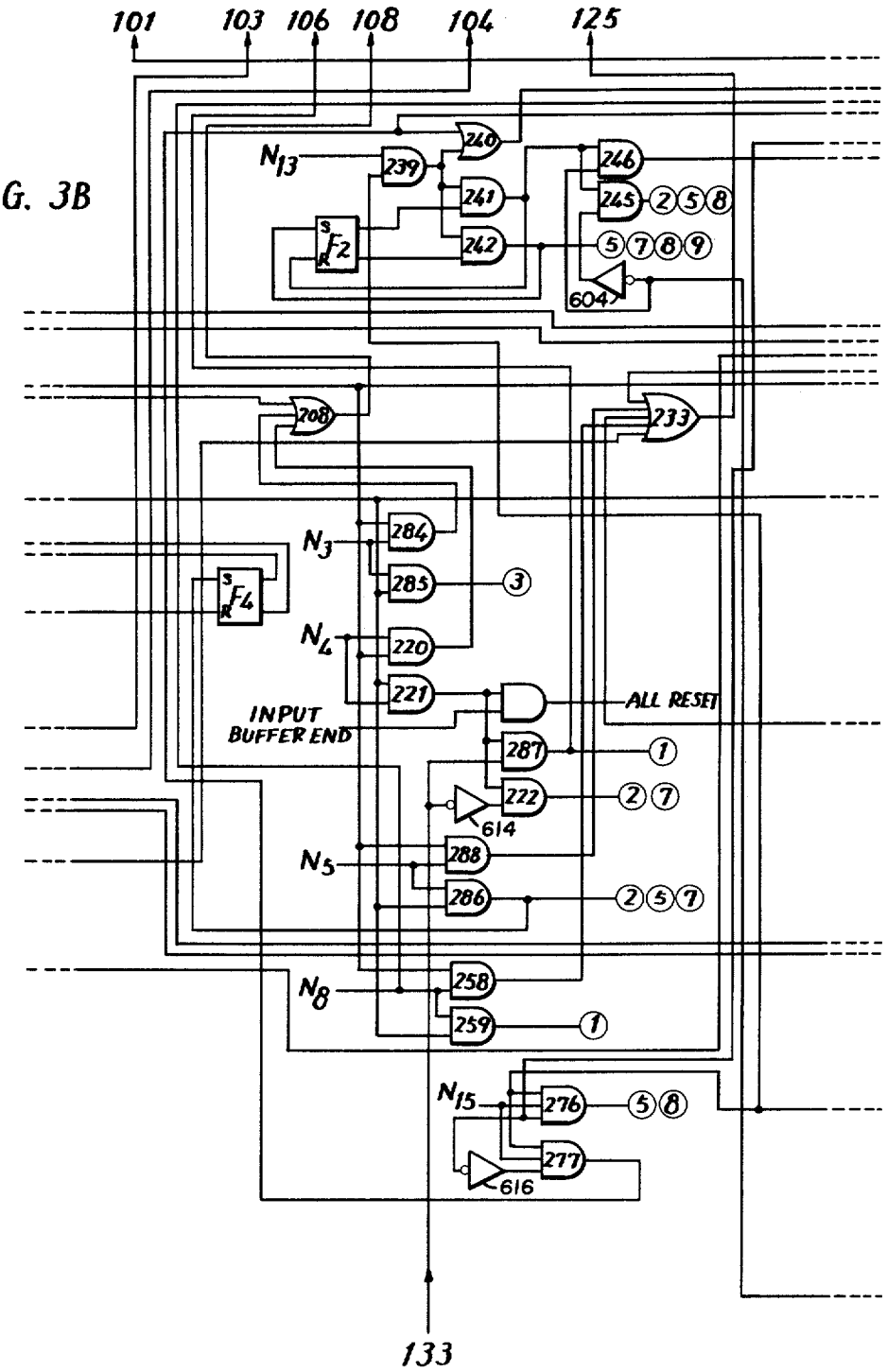
Figure 3C:
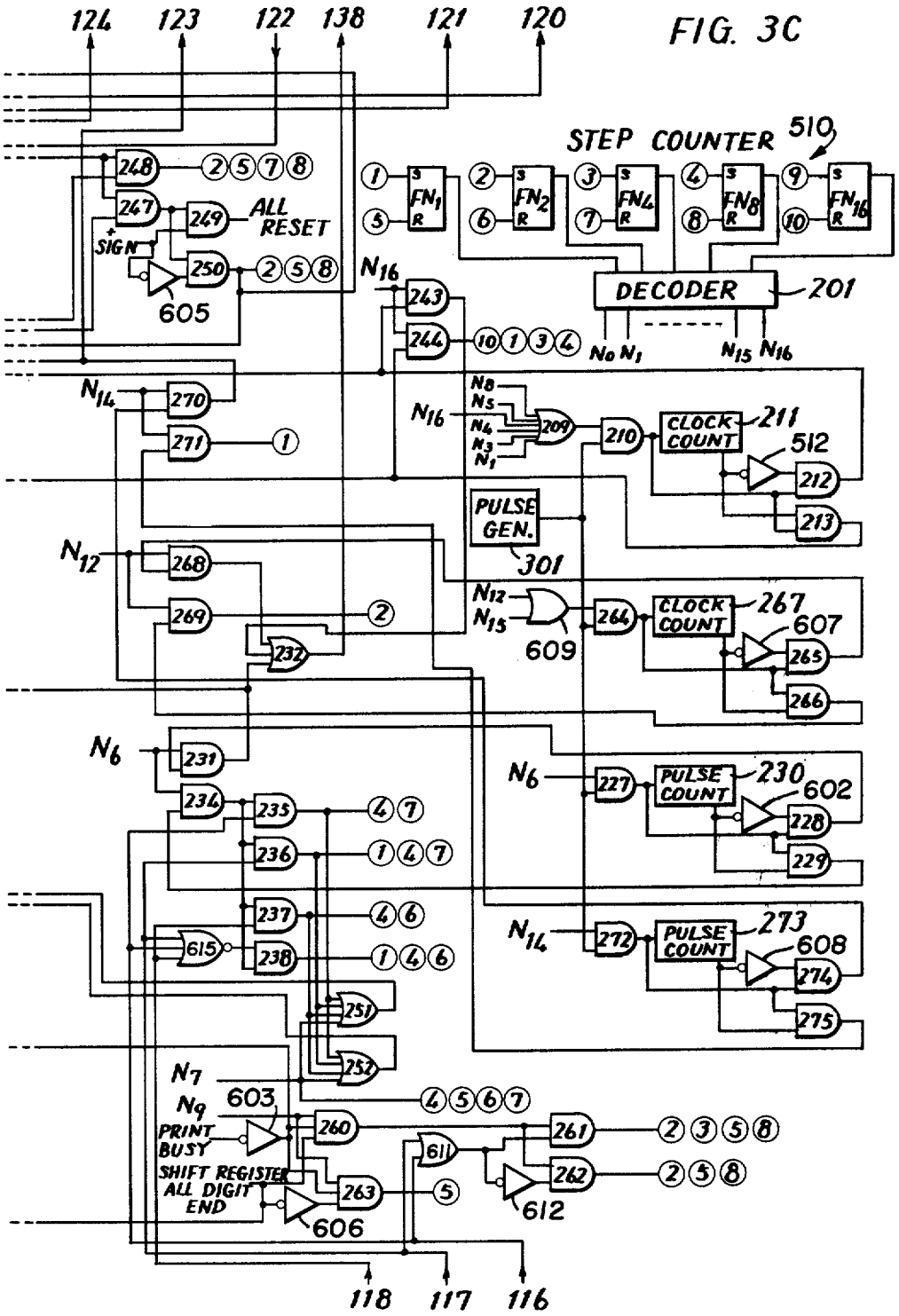
Figure 4A:
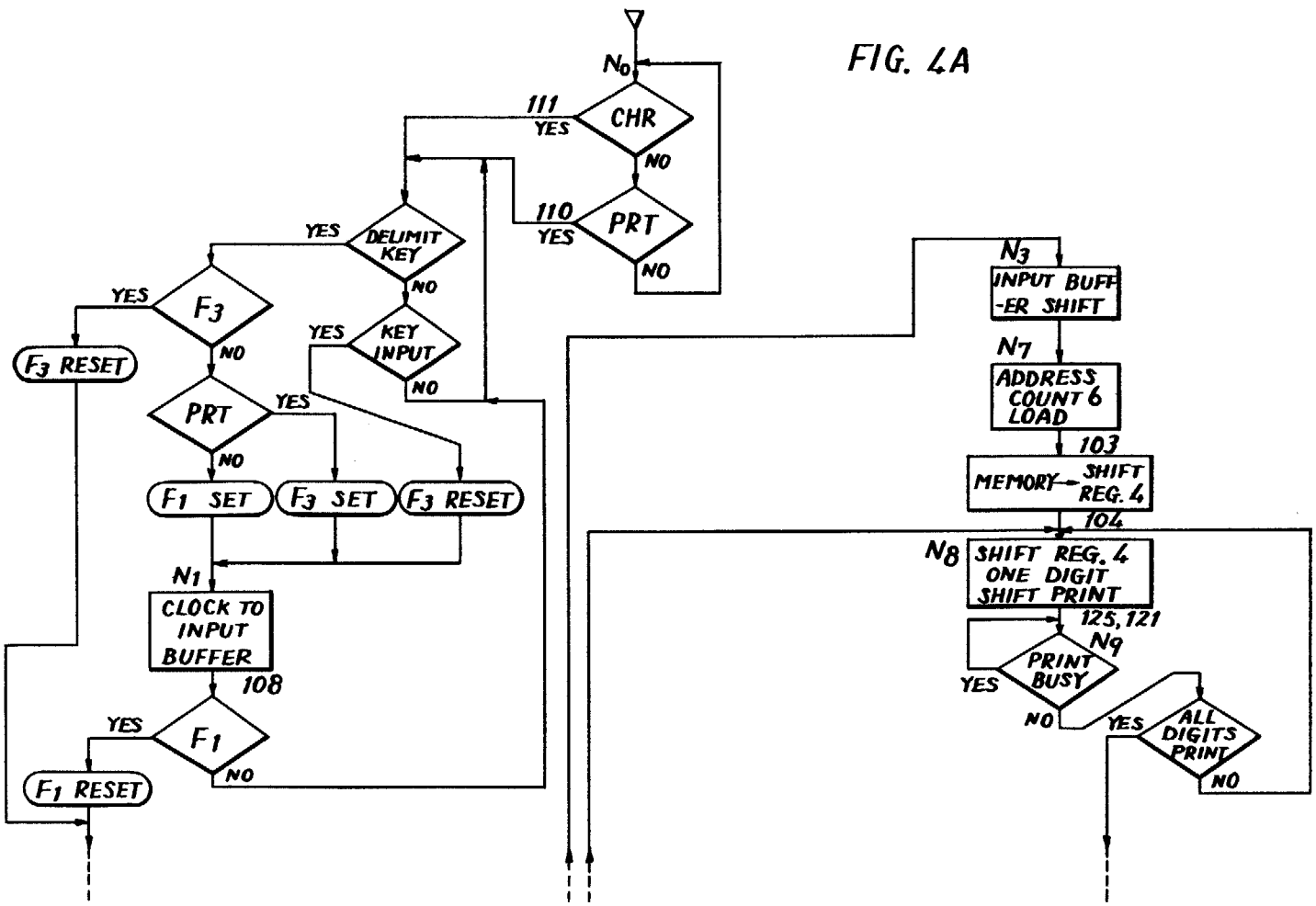
FIGS. 4A–C form a flow chart showing the operation of the FIG. 3 timing control.
Figure 4B:
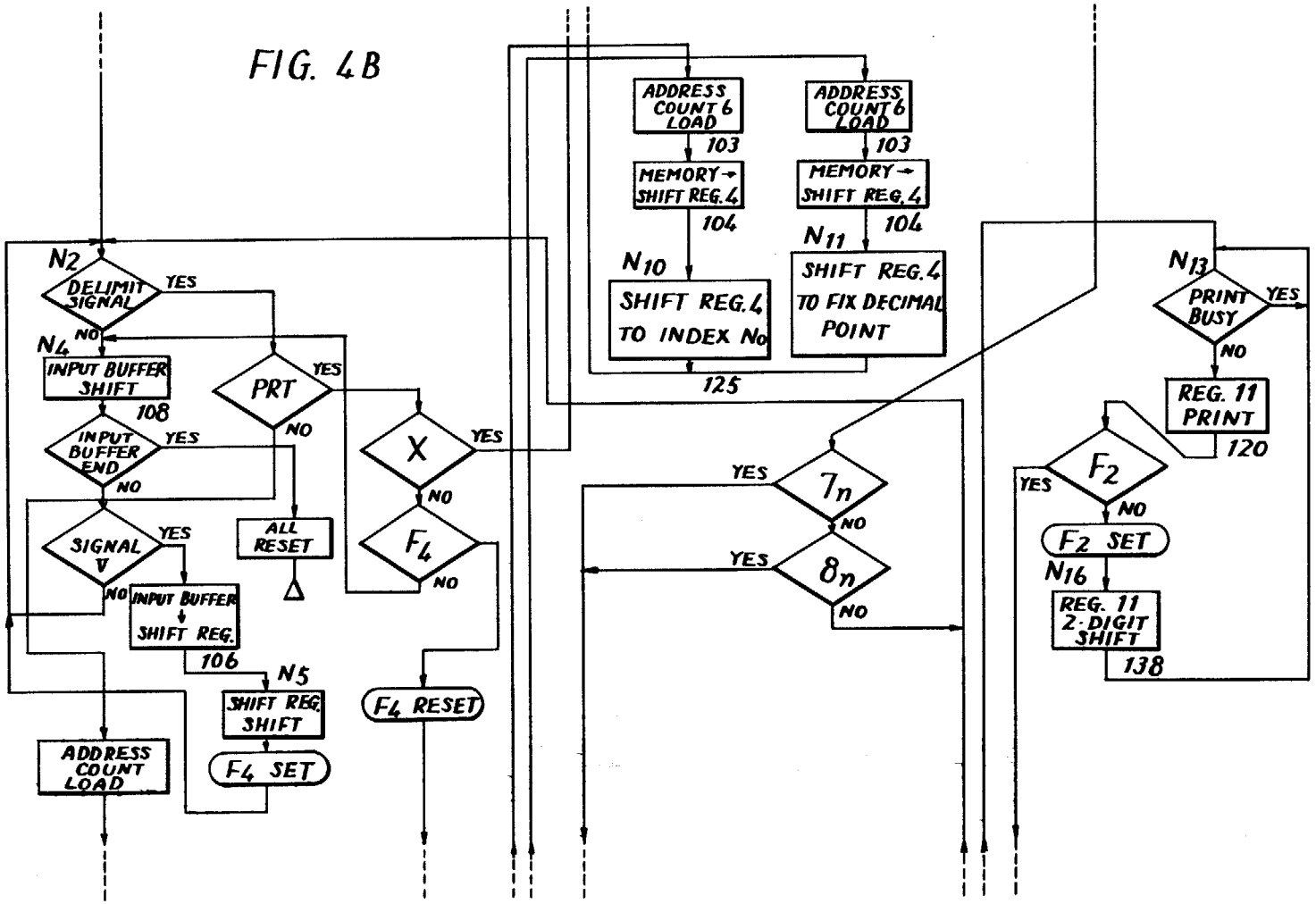
Figure 4C:
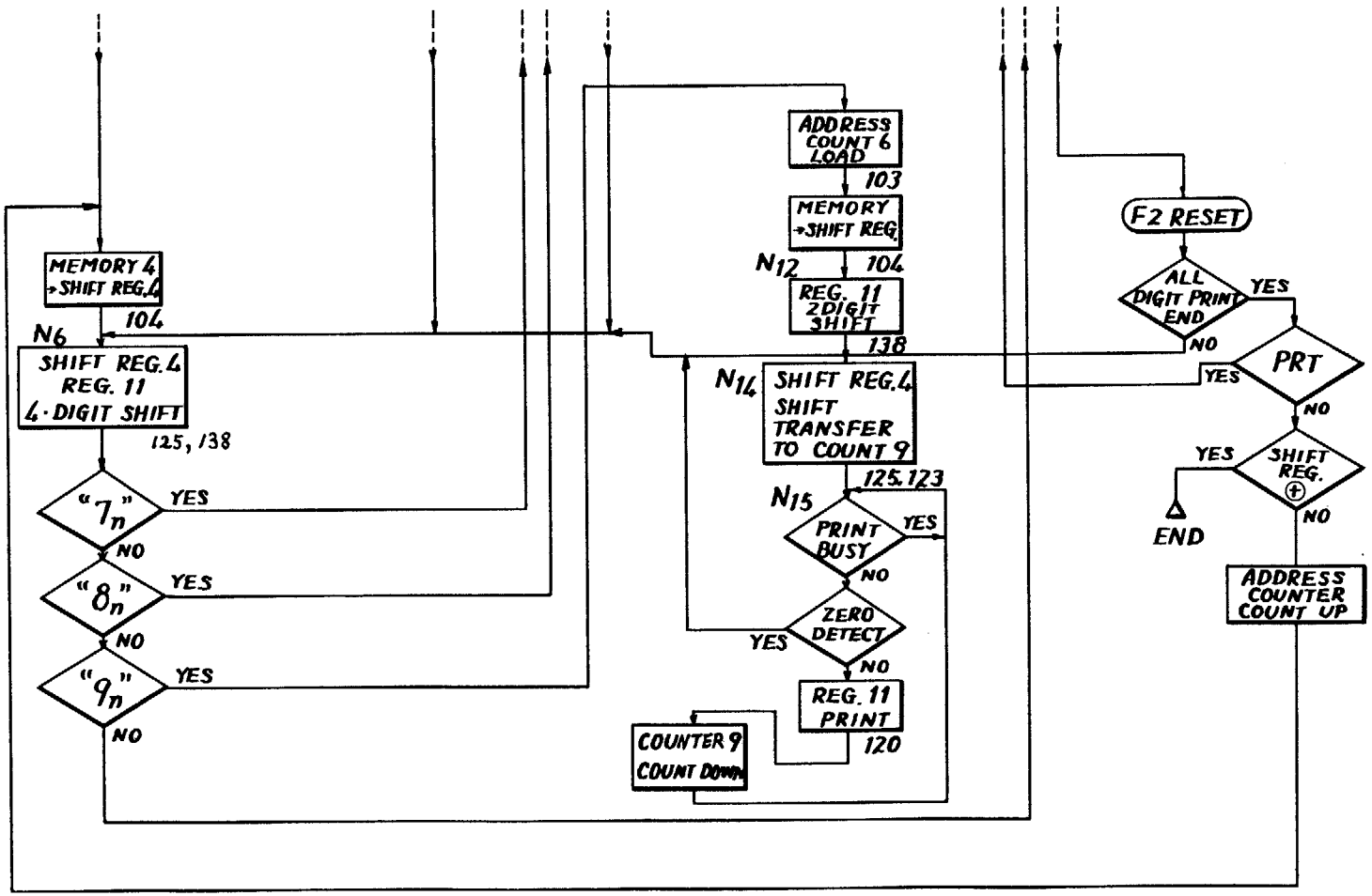

FIGS. 3A-3C form a block diagram of the timing control 2 in the FIG. 2B embodiment and FIGS. 4A-C form a flow chart showing the operation of the FIGS. 3A-C timing control 2. Referring to FIGS. 3A-C, the block of the timing control 2 is shown comprising various logical components connected as shown while the same signal lines are shown extending from the timing control 2. In the upper right corner of the timing control 2 in FIG. 3C, a step counter 510 comprises flip-flops FN1, FN2, FN4, FN8 and FN16, which are coupled in parallel to a decoder 201. The output terminals N0, N1, N2, . . . N15, and N16 from the decoder 201 are individually applied to the corresponding input terminals as shown throughout in the figure and denoted by the same reference characters N0, N1, N2, . . . N15 and N16, respectively. More specifically, each of the outputs obtainable at the output terminals N0, N1, N2, . . . N15 and N16 are applied to the corresponding input terminal identified by the same reference character, thereby to enable a circuit portion associated therewith. The circuit portions associated with these input terminals N0, N1, N2, . . . N15 and N16 are interconnected as shown in FIGS. 3A-C, whereby a signal is obtained at each corresponding signal line extending from the timing control 2 shown in FIGS. 3A-C. It is pointed out that the outputs obtainable at these output terminals N0, N1, N2, . . . N15 and N16 are each representative of the steps in the operation of the FIGS. 3A-C diagram of the timing control 2. The corresponding steps have been identified in the FIGS. 4A-C flow chart by the same reference characters. The detailed structure of the circuit configuration of the FIGS. 3A-C embodiment and the operation thereof will be better understood from the following description with simultaneous reference to FIGS. 3A-C and 4A-C. For the purpose of describing the circuit configuration and the operation of the FIGS. 3A-C embodiment, the operation of the embodiment will be described by taking several examples wherein different combinations of key entries are effected.

(1) In the case where the character code entry mode key CHR, the memory section entry mode key X, the numeral key 1, and the delimitation key "," are operated in the order described.

(a) In the initial condition, the flip-flops FN1, FN2, FN4, FN8 and FN16 all have been reset, whereby an output is obtained at the terminal N0 of the decoder 201. Similarly all the flip-flops in the FIGS. 3A-C diagram have been reset.

(b) If and when the character code entry mode key CHR is depressed, in such a situation, the flip-flop 30 (see FIG. 2A) is reset.

(c) If and when the memory section entry mode key X and the numeral key 1 are depressed and the delimitation key "," is not depressed so as to produce a high signal at the output of inverter 617 to enable AND gate 203, in such a situation, the AND gates 203 and 204 are enabled and the output from the AND gate 204 is obtained through the OR gate 206 as the signal ① . Similarly the output from the AND gate 204 is applied through the OR gate 205 to the flip-flop F3, whereby the flip-flop F3 is reset.

(d) The signal ① obtained at the output of the OR gate 206 is applied to the set input of the flip-flop FN1 of the step counter 510, so that the flip-flop FN1 is set, which causes one step count, with the result that the output from the decoder 201 is shifted from the terminal N0 to the terminal N1.

(e) The output obtained at the terminal N1 of the decoder 201 is applied to the AND gate 207 (FIG. 3A) directly and to the AND gate 210 (FIG. 3C) through the OR gate 209, whereby the AND gates 207 and 210 are enabled. Since the AND gate 210 is enabled, a pulse signal obtained from a pulse generator 301 is allowed to pass through the AND gate 210 and is counted by the clock counter 211. The count output of the clock counter 211 is obtained through the inverter 512 and the AND gate 212 and is withdrawn through the AND gate 207 and the OR gate 208 at the signal line 108. The signal obtained at the signal line 108 is applied to the input buffer 3 (see FIG. 2A) as a clock signal therefor. As a result, a key code as inputted is stored in the input buffer 3.

(f) The final count output is obtained through the AND gate 213 (FIG. 3C) and the same is withdrawn through the AND gates 214 (FIG. 3A) and 215 as the signal ⑤, which is applied to the reset input of the flip-flop FN1 of the step counter 510, whereby the flip-flop FN1 is reset and accordingly the output from the decoder 201 is returned from the terminal N1 to the terminal N0.

(g) Now the situation described in the preceding paragraph (c) is regained and thereafter substantially the same operation described in the paragraphs (c) through (f) is repeated for further entry through the numeral key 1. As a result, the key codes standing for the memory section entry mode key X and the numeral key 1 are stored in the input buffer 3.

(h) If and when the delimitation key "," is depressed in such a situation, the signal representative of depression of the delimitation key "," is applied through the AND gates 216 and 217 (FIG. 3A) to the set input of the flip-flop F1, whereby the flip-flop F1 is set. At the same time the signal representative of depression of the delimitation key "," is obtained through the AND gates 216 and 217 and further through the OR gate 206 as the signal ①, which is applied to the set input of the flip-flop FN1 of the step counter 510. As a result, the output from the decoder 201 is shifted from the terminal N0 to the terminal N1.

(i) The clock counter 211 is responsive to the output from the terminal N1 and the output is obtained through the AND gate 212, which is further transferred through the AND gate 207 and the OR gate 208 and is withdrawn through the signal line 108 as a clock signal. The final count output at the clock counter 211 is obtained through the AND gate 213 and further transferred through the AND gates 214 and 218 and is withdrawn as signals ② and ⑤. Since the signal ② is applied to the set input of the flip-flop FN2 of the step counter 510, the flip-flop FN2 is set. As a result, the output from the decoder 201 is shifted from the terminal N1 to the terminal N2.

(j) In case where the output is obtained from the terminal N2 of the decoder 201 when the key code data as read out from the input buffer 3 is not of the key code of the delimitation key ",", then the signal from line 109 is low. This signal is inverted by an inverter 601 which enables the AND gate 219 and the output from the AND gate 219 is withdrawn as signals ③ and ⑥. The signal ③ is applied to the set input of the flip-flop FN4 and the flip-flop FN4 is set. As a result, the output from the decoder 201 is shifted from the terminal N2 to the terminal N4. It is pointed out that in the example now in discussion, the key code standing for the memory section entry mode key X has been read out.

(k) The clock counter 211 is responsive to the output at the terminal N4 of the decoder 201 and the output pulse therefrom is obtained through the AND gate 212 and further through the AND gate 220 (FIG. 3B) enabled by the signal N4 and further through the OR gate 208 at the signal line 108 as a clock signal for the input buffer 3. The final count output at the clock counter 211 is obtained through the AND gate 213 and further through the AND gates 221 and 222 as signals ② and ⑦. The flip-flop FN2 of the step counter 510 is set responsive to the signal ②. As a result, the output from the decoder 201 is shifted from the terminal N4 to the terminal N2.

(l) The operation described in the preceding paragraphs (j) through (k) is repeated until the delimitation key "," is depressed and the key code standing for the delimitation key "," is obtained. In the example now in discussion, the operation for entry through the memory section entry mode key X and the numeral key 1 is repeated.

(m) If and when the delimitation key "," is depressed and the signal representative of depression of the delimitation key "," is obtained at the signal line 109, the signal is allowed to pass through the AND gate 223 and further through the AND gate 224 and is withdrawn as a signal ③. At the same time, the signal is obtained through the AND gates 223 and 224 and further through the OR gate 225 at the signal line 103, whereby the address data representative of the memory section No. 1 is applied to the address counter 6 (see FIG. 2B). Similarly, another signal is obtained further through the OR gate 226 at the signal line 104, whereby the data in the section as addressed is read out and is stored in the shift register 4 (see FIG. 2B). Since the flip-flop FN4 is set responsive to the signal ③, the output from the decoder 201 is shifted from the terminal N2 to the terminal N6.

(n) The AND gate 227 (FIG. 3C) is enabled responsive to the signal N6 and accordingly a pulse is applied from the pulse generator 301 to the pulse counter 230. A count output signal is obtained through the inverter 602 and AND gate 228, so that a pulse signal for 4-digit shifting operation is withdrawn. The signal N6 enables the AND gate 231 and the output from the AND gate 231 is obtained through the OR gate 233 (FIG. 3B) at the signal line 125, which is applied to the shift register 4 (see FIG. 2B) as a 4-digit shifting clock signal. Similarly the output from the AND gate 231 enabled by the signal N6 is obtained through the OR gate 232 at the signal line 138, which is applied to the register 11 (see FIG. 2C) as a 4-digit shifting clock signal. Accordingly, the data in the shift register 4 is circulated by four digits and 4-digit data is transferred to the register 11. The final count signal in the counter 230 is withdrawn through the AND gate 229, which enables the AND gate 234, so that the AND gates 234, 235, 236, 237 and 238 are all enabled. Any one of these AND gates 235, 236, 237 and 238 allows to pass therethrough the signals at the signal lines 116, 117 and 118, so that the corresponding signals indicated at the outputs of these AND gates 235, 236, 237 and 238 are obtained and applied to the flip-flops $FN_1$, $FN_2$, $FN_4$, $FN_8$, $FN_{16}$ of the step counter 510 (see FIG. 3C). As a result, the output of the decoder 201 is shifted to any one of the terminals N10, N11, N12 and N13.

(1-1) In the case where the data stored in the memory section X1 is "30 31 32 F 30 31 32"

As described in the foregoing paragraphs (a) through (n) in the preceding section (1), the above described data has been loaded in the shift register 4 and the data of four digits "30 31" has been loaded in the register 11 through the 4-digit shifting operation.

(a) As described in the section (n) in the preceding paragraph (1), the AND gate 238 is enabled and the signals ①, ④ and ⑥ are obtained when the output of NOR gate 615 goes high. The output of this NOR gate 615 goes high only when the inputs on lines 116–118 are all low. As a result the output obtainable from the decoder 201 is shifted from the terminal N6 to the terminal N13.

(b) When the output is obtained at the terminal N13 of the decoder 201, the AND gate 239 (FIG. 3B) is enabled, while the print busy signal obtainable from the printer 500 (which assumes the low level only when the printing operation is possible) is also applied to the AND gate 239 via an inverter 603 (FIG. 3C). As a result the output is obtained from the AND gate 239, which is obtained through the OR gate 240 at the signal line 120 to enable the gate 12 (see FIG. 2C), whereby the two-digit data "30" stored in the digit positions a and b of the register 11 (see FIG. 2C) is applied to the character generator 7 (see FIG. 2C), thereby to print out the English alphabet character "A". At the same time the signals ⑤, ⑦, ⑧ and ⑨ are obtained from the AND gate 242, and the flip-flop F2 is set. As a result the output obtained from the decoder 201 is shifted from the terminal N13 to the terminal N16.

(c) When the output signal N16 is obtained, the count pulse is obtained from the clock counter 211 through the AND gate 212 and further through the AND gate 243 and the OR gate 232 at the signal line 138 as a clock signal to be applied to the register 11 (FIG. 2C), whereby the register 11 makes a 2-digit shifting operation. The final count output pulse is obtained from the clock counter 211 through the AND gate 213 and is withdrawn through the AND gate 244 as signals 1, ③, ④ and ⑩. As a result, the output obtained from the decoder 201 is shifted from the terminal N16 to the terminal N13.

(d) If and when the output is obtained at the terminal N13 of the decoder 201, a signal is withdrawn through the AND gate 239 and the OR gate 240 at the signal line 120. As a result, the two-digit data "31" stored in the register 11 (see FIG. 2C) is printed out as the English alphabet character "B". At the time, as described in the preceding paragraph (1-1) (b), since the flip-flop F2 has been set, the gate 241 (see FIG. 3B) is opened, and since not all the digits of the data in the shift register 4 have been printed, the gate 245 is opened, so that the signals ② ⑤ and ⑧ are obtained and are fed from the terminal N13 to the terminal N6. Since the data of all the digits stored in the shift register 4 has not been printed out, the AND gate 245 is enabled via an inverter 604 and the output of the AND gate 245 is withdrawn as the signals ②, ⑤ and ⑧. As a result, the output obtained from the decoder 201 is shifted from the terminal N13 to the terminal N6.

(e) As described in the paragraph (n) in the preceding section (1), when the output signal is obtained at the terminal N6 of the decoder 201, the shift register 4 and the register 11 make a 4-digit shifting operation, whereby the data is loaded in the register 11.

(f) The operation described in the paragraphs (a) through (e) is repeated and the English alphabet character "C" is printed in accordance with the two-digit data "32". Since the following data is the key code F representative of depression of the language kind specifying key F, the flip-flop 32 (see FIG. 2C) is set, whereby the character generator 7 is controlled to the kana letter mode. In such a situation, the operation described in the paragraph (n) in the preceding section (1) and the paragraphs (a) through (e) in the present section (1-1) is repeated. As a result, the Japanese kana letters "  " are printed out in accordance with the two-digit data "30 31 32". At the operation described in the paragraph (d) in the present section (1-1), the shift register 4 is detected of the end of the data, whereby the gates 246 and 247 (FIGS. 3B and 3C) are enabled. If and when the data in the shift register 4 comes to an end in the above described paragraph (d) in the section (1-1), the gates 246 and 247 are opened and when the flip-flop 22 (FIG. 2B) has been reset upon detection of the plus sign, the gate 249 is opened via inverter 605 so that all the flip-flops are reset, thereby to complete the operation. On the other hand, when the flip-flop 22 has been reset upon detection of the minus sign, the gate 250 is opened, whereby the signals ②, ⑤ and ⑧ are obtained and are transferred from the terminal N13 to the terminal N6 and are obtained from the signal line 104 through the signal line 101 and the gate 226 (FIG. 3A) and the data in the memory section Xn is read in the shift register 4 (FIG. 2B), whereupon the above described operation described in the paragraph (n) in the section (1) and the paragraphs (a) through (f) in the section (1-1) is repeated. If and when the plus sign is detected while the flip-flop 22 (see FIG. 2B) is reset, the AND gate 249 is enabled, so that all the flip-flops are reset and the operation is terminated. In case where the minus sign is detected while the flip-flop 22 is reset, the gate 250 is enabled and the signals ②, ⑤ and ⑧ are obtained. As a result the output from the decoder 201 is shifted from the terminal N13 to the terminal N6, while the signal is withdrawn directly at the signal line 101 and through the OR gate 226 at the signal line 104. Thus, the data of the following memory section is loaded in the shift register 4 and the operation described in the paragraph (n) in the preceding section (1) and the paragraphs (a) through (f) in the present section (1-1) is repeated.

(1-2) In the case where the data in the memory section X1 is "7252"

The data "7252" is loaded in the shift register 4 (see FIG. 2B) in accordance with the operation described in the paragraphs (a) through (n) in the preceding section (1), and then the register 11 (see FIG. 2) is also loaded with the data "7252" through the 4-digit shifting operation.

(a) As described in the paragraph (n) in the preceding section (1), the signal N6 is obtained at the terminal N6 of the decoder 201. The numerical value "7" is detected at the digit position a of the register 11 and the detected output is obtained at the signal line 116. As a result the AND gate 235 is enabled and the output from the AND gate 235 is obtained as signals ④ and ⑦. As a result, the output from the decoder 201 is shifted from the terminal N6 to the terminal N10. The signal is also obtained through the OR gates 251, 252, 225 and 226 at the signal lines 103 and 104, whereby the data representative of the memory section No. X2 is loaded in the address counter 6 (see FIG. 2B) and the data in the memory 5 is stored through the gate 20 in the shift register 4.

(b) If and when the output is obtained at the terminal N10 of the decoder 201, the data for specifying the number of digits of the integer portion as five digits is obtained at the signal line 115 and is applied through the gate 253 to a floating decimal point changing circuit 302. Further data specifying the number of digits in the fraction portion as two digits is obtained at the signal line 114 and is applied through the gate 254 to a floating decimal point changing circuit 302. The following decimal point changing circuit 302 is responsive to these input signals from the AND gates 253 and 254 to generate a clock signal which is obtained through the OR gate 257 at the signal line 125, thereby to change the digit position of the decimal point. Thereafter the signal ⑥ is obtained from the floating decimal point changing circuit 302, whereby the output from the decoder 201 is changed from the terminal N6 to the terminal N8.

(c) If and when the output is obtained at the terminal N8 of the decoder 201, the count pulse is obtained from the clock counter 211, which is applied through the AND gate 212 and further through the AND gate 258 (FIG. 3B) and the OR gate 233 and through the signal line 125 to the shift register 4 as a clock signal, whereby the shift register 4 makes a one-digit shifting operation. The signal N8 obtained at the terminal N8 of the decoder 201 is also withdrawn through the signal line 121, whereby the data in the shift register 4 is transferred to the character generator 7 to make a printing operation. The final count output pulse from the clock counter 211 is obtained through the AND gate 213 and through the AND gate 259 (FIG. 3B) as the signal ①. As a result, the output of the decoder 201 is shifted from the terminal N8 to the terminal N9.

(d) In the case where the print busy signal assuming the logic zero when the printing operation is possible is obtained while the output is obtained at the terminal N9 of the decoder 201, the output is obtained from the AND gate 263, which is enabled via inverter 606, as the signal ⑤. As a result the output of the decoder 201 is shifted from the terminal N9 to the terminal N8.

(e) The operation described in the paragraphs (c) through (d) in the present section (1-2) is repeated, and when the data of all the digits in the shift register 4 is printed, the signals ②, ③, ⑤ and ⑧ are withdrawn through the AND gates 260 and 261. As a result, the output of the decoder 201 is shifted from the terminal N9 to the terminal N6, whereupon the original data is regained in the shift register 4 and the operation described in the paragraph (a) in the preceding section (1) is executed. If and when the data in the input buffer 3 runs out, then all the flip-flops are reset, thereby to terminate the operation.

(1-3) In the case where the data in the memory section X1 is "8252"

In the present example, substantially the same operation as described in the section (1-2) is carried out. More specifically, if and when the output is obtained at the terminal N6 of the decoder 201, the AND gates 234 and 236 are enabled and the signals ①, ④ and ⑦ are obtained. As a result, the output of the decoder 201 is shifted from the terminal N6 to the terminal N11. When the output is obtained at the terminal N11 of the decoder 201, the signals specifying the number of digits in the fraction portion and the number of digits in the integer portion as "two digits" and "five digits", respectively, obtained at the signal lines 114 and 115, respectively, are applied through the enabled AND gates 255 and 256 (FIG. 3A) to the fixed decimal point changing circuit 303, while the clock signal is applied through the signal line 125 to the shift register 4, whereby the data in the memory section number X2 is changed to the fixed decimal point and thereafter the signals ⑤ and ⑥ are obtained from the fixed decimal point changing circuit 303. As a result the output from the decoder 201 is changed from the terminal N11 to the terminal N8. Thereafter the operation as described in the paragraph (c) in the preceding section (1-2) is carried out.

(1-4) In the case where the data in the memory section X1 is "9230"

As described in the paragraph (n) in the preceding section (1), the output is obtained at the terminal N6 of the decoder 201, whereupon the said data "9230" is stored in the register 11 (see FIG. 2C).

(a) When the output is obtained at the terminal N6 of the decoder 201, the signal is withdrawn at the signal line 118 and the signals ④ and ⑥ are obtained through the AND gates 234 and 237. As a result, the output of the decoder 201 is shifted from the terminal N6 to the terminal N12. At the same time the signals are obtained at the signal lines 103 and 104 through the OR gates 251, 252, 225 and 226, whereby the data representative of the memory section No. X2 is loaded in the address counter 6 (see FIG. 2B), whereupon the gate 20 (see FIG. 2B) is enabled, so that the data stored in the memory section No. X2 of the memory 5 (see FIG. 2B) is loaded in the shift register 4 (see FIG. 2B). In the present example, the data is assumed to be "3".

(b) When the output is obtained at the terminal N12 of the decoder 201, the pulse is applied through the OR gate 609 and AND gate 264 to the clock counter 267, whereby the clock counter 267 makes a counting operation of a two-digit shifting pulse, whereupon the count pulse is obtained through the AND gate 265 and inverter 607. The clock pulse is obtained through the AND gate 268 and through the OR gate 232 at the signal line 138. As a result, the register 11 makes a two-digit shifting operation. The final count pulse is obtained from the clock counter 267 through the AND gate 266 and the signal ② is obtained through the AND gate 269. As a result, the output of the decoder 201 is shifted from the terminal N12 to the terminal N14.

(c) When the output is obtained at the terminal N14 of the decoder 201, the pulse is applied through the AND gate 272 to the pulse counter 273, whereby the count pulse is obtained from the pulse counter 273 through inverter 608 and the AND gate 274. As a result, the clock signal is applied through the AND gate 270 at the signal line 123 and through the OR gate 233 at the signal line 125, whereby the numerical value data "3" in the shift register 4 is transferred to the counter 9 (see FIG. 2C). The final count pulse is obtained from the pulse counter 273 through the AND gate 275 and the signal ① is obtained through the AND gate 271. As a result, the output from the decoder 201 is shifted from the terminal N14 to the terminal N15.

(d) In the case where the print busy signal assuming the logic zero indicating that the printing operation is possible is obtained while the output is obtained at the terminal N15 of the decoder 201, the signals are obtained at the signal lines 124 and 120 through the AND gate 277 (FIG. 3B) and the OR gate 240, whereby the counter 9 (see FIG. 2C) makes a one down count operation while the gate 20 (see FIG. 2B) is enabled, thereby to print out the English alphabet character "A" corresponding to the data "30" in the register 11 (see FIG. 2C). The printing operation of the English alphabet character "A" is repeated, until the signal produced by inverter 616 by inverting the signal on line 122 becomes the logic zero after the printing operation is completed, and upon detecting the logic one at the signal line 122 the AND gate 276 is enabled to provide the signals ⑤ and ⑧. As a result, the output of the decoder 201 is shifted from the terminal N15 to the terminal N6, whereupon the state described in the paragraph (n) in the preceding section (1) is regained and the operation is terminated when the data runs out.

(2) In the case where the numeral print mode key PRT, the memory section entry mode key X, the numeral key 1, the delimitation key ",", the memory section entry mode key X, the numeral key 2, the delimitation key "," and the delimitation key "," are operated in the order described.

(a) If and when the numeral print mode key PRT is depressed, the flip-flop 31 (see FIG. 2A) is set. If and when any key other than the delimitation key "," is depressed while the output is obtained at the terminal N0 of the decoder 201, the signal ① is obtained through the AND gates 203 and 204, whereby the output from the decoder 201 is changed from the terminal N0 to the terminal N1. The flip-flop F3 (FIG. 3A) is also reset responsive to the output from the AND gate 204 through the OR gate 205.

(b) When the output is obtained at the terminal N1 of the decoder 201, the clock signal is obtained at the signal line 108 through the AND gate 207, whereby the key code signal is loaded in the input buffer 3 (see FIG. 2A). The signal ⑤ is obtained through the AND gates 214 and 215. As a result, the output of the decoder 201 is changed from the terminal N1 to the terminal N0.

(c) The operation described in the paragraphs (a) and (b) in the present section (2) is repeated until the delimitation key "," is depressed. If and when the delimitation key "," is operated, the flip-flop F3 is set through the AND gates 216 and 278, whereby the signal ① is obtained. As a result, the output of the decoder 201 is changed from the terminal N0 to the terminal N1.

(d) When the output is obtained at the terminal N1 of the decoder 201, the clock signal is applied to the input buffer 3 (see FIG. 2A) as described in the paragraph (b) in the present section (2), whereby the code signal representative of the entry of the delimitation key "," is loaded, whereupon the output of the decoder 201 is changed to the terminal N0.

(e) The operation described in the paragraphs (a) through (c) in the present section (2) is carried out. If and when the delimitation key "," is operated two times repeatedly while the output is obtained at the terminal N0 of the decoder 201, the signal ② is obtained through the AND gate 279. AND gate 279 is enabled by setting of either flip-flop 31 or flip-flop 30 through OR gate 610 by actuation of either the print key PRT or the character key CHR. As a result, the output of the decoder 201 is changed from the terminal N0 to the terminal N2, while the flip-flop F3 is reset.

(f) When the output is obtained at the terminal of the decoder 201, the signals ③ and ⑥ are obtained through the AND gate 219. As a result, the output of the decoder 201 is changed from the terminal N2 to the terminal N4.

(g) When the output is obtained at the terminal N4 of the decoder 201, the clock signal is obtained at the signal line 108 through the AND gate 220 (FIG. 3B) and the OR gate 208, whereby the input buffer 3 (see FIG. 2A) makes a shifting operation. Upon completion of the shifting operation in the input buffer 3, the signals ② and ⑦ are obtained through the AND gates 221 and 222, AND gate 222 being enabled by a high signal from inverter 614. As a result, the output of the decoder 201 is shifted from the terminal N4 to the terminal N2.

(h) The operation described in the paragraphs (f) and (g) in the present section (2) is repeated, whereby the data in the memory section X1 is read out. If and when the code signal representative of the delimitation key "," is read out, the signal ① is obtained through the AND gates 280 (FIG. 3A) and 282. As a result, the output of the decoder 201 is shifted from the terminal N2 to the terminal N3.

(i) When the output is obtained at the terminal N3 of the decoder 201, the clock signal is obtained at the signal line 108 through the AND gate 284 (FIG. 3B) and is applied to the input buffer 3 (see FIG. 2A), whereby the input buffer 3 makes a shifting operation. The signal ③ is also obtained through the AND gate 285. As a result, the output of the decoder 201 is changed from the terminal N3 to the terminal N7.

(j) When the output is obtained at the terminal N7 of the decoder 201, the signals are obtained at the signal lines 103 and 104 through the OR gates 251 and 252, whereby the data in the specified memory section X1 is loaded through the gate 20A (see FIG. 2B) in the shift register 4. The signals ④, ⑤, ⑥, and ⑦ are also obtained. As a result, the output of the decoder 201 is shifted from the terminal N7 to the terminal N8.

(k) When the output is obtained at the terminal N8 of the decoder 201, the clock signal is obtained at the signal line 125 and accordingly the shift register 4 (see FIG. 2B) makes a one-digit shifting operation. The signal is also obtained at the signal line 121 and the data of one digit in the shift register 4 (see FIG. 2B) is printed out and at the same time the signal ① is obtained through the AND gate 259. As a result, the output of the decoder 201 is shifted from the terminal N8 to the terminal N9.

(l) When the output is obtained at the terminal N9 of the decoder 201, the signal ⑤ is obtained through the AND gate 263 (FIG. 3C) in the print enabled state when no signal appears on lines 116, 117 and thus the output of OR gate 611 is low and a high signal is applied to AND gate 262 by inverter 612, whereby the output of the decoder 201 is changed from the terminal N9 to the terminal N8.

(m) The operation described in the paragraphs (k) and (l) in the present section (2) is repeated, as the data is shifted in the shift register 4 and is printed out. If and when the printing operation of all digits is completed, the signals ②, ⑤ and ⑧ is obtained through the AND gate 262. As a result, the output of the decoder 201 is changed from the terminal N9 to the terminal N2. The above described execution achieves the operation for the code signals representative of the memory section entry mode key X, the numeral key 1 and the delimitation key ",". Then the operation described in the paragraphs (a) through (m) in the present section (2) is carried out, thereby to execute the operation of the code signals for the memory section entry mode key X, the numeral key 2, and the delimitation key ",". When the data in the input buffer 3 runs out the output of AND gate 613 goes high and thus all the flip-flops are reset, thereby to terminate the operation.

(3) In the case where the numeral print mode key PRT, the numeral/language character selecting key V, the numeral key 3, the numeral key 0, the numeral key 3, the numeral key 1, the numeral key 3, the numeral key 2, the numeral/language character selecting key V, the delimitation key ",", and the delimitation key ",", are depressed in the order described.

In the manner of operation described in the paragraphs (a) through (e) in the above described section (2), the code signals standing for the numeral/language character selecting key V, the numeral key 3, the numeral key 0, the numeral key 3, the numeral key 1, the numeral key 3, the numeral key 2, the numeral/language character selecting key V, and the delimitation key "," are loaded in the input buffer 3 responsive to depression of these keys.

(a) When the output is obtained at the terminal N2 of the decoder 201, the signals ③ and ⑥ are obtained through the AND gate 219 (FIG. 3A). As a result, the output of the decoder 201 is shifted from the terminal N2 to the terminal N4.

(b) When the output is obtained at the terminal N4 of the decoder 201, the clock signal is obtained at the signal line 108 through the AND gate 220 (FIG. 3B) and the OR gate 208 and is applied in the input buffer 3, whereby the input buffer 3 makes the shifting operation. The signal is also obtained at the signal line 106 to transfer the data in the shift register 4. The signal ① is obtained through the AND gates 221 and 287. As a result, the output of the decoder 201 is changed from the terminal N4 to the terminal N5.

(c) When the output is obtained at the terminal N5 of the decoder 201, the clock signal is obtained at the signal line 125 through the AND gate 288 which is applied to the shift register 4, whereby the shift register 4 makes a one digit shifting operation. The signals ②, ⑤, and ⑦ are obtained through the AND gate 286. As a result, the output of the decoder 201 is shifted from the terminal N5 to the terminal N2 and the flip-flop F4 is set.

(d) The operation described in the paragraphs (a) through (c) in the present section (3) is repeated, while the numerical value codes "303132" are loaded in the shift register 4. When the signal representative of the delimitation key "," is obtained while the output signal N2 is obtained from the decoder 201, the signal ③ is obtained through the AND gates 223 (FIG. 3A), 280 and 281. Therefore, the output of the decoder 201 is changed from the terminal N2 to the terminal N6. The flip-flop F4 (FIG. 3B) is also reset.

(e) Thereafter substantially the same operation as described in the paragraph (n) in the preceding section (1) and in the preceding section (1-2) is followed. Thus the English alphabet characters "ABC" corresponding to the numerical value codes "30", "31", "32" are printed out. When the data in the input buffer 3 runs out, all the flip-flops are reset, thereby to terminate the operation. Thereafter the same operation as described in the paragraph (n) in the section (1) and the sections (1-1), (1-2), (1-3) and (1-4) is performed, whereby the characters A, B, C corresponding to the numerical values 30, 31 and 32 are printed. A different point from the previously described operation is the description in the paragraph (t) in the section (1-1).

Since the mode now in description is the PRT mode, the same is more or less different from the previously described CHR mode. The flip-flop F2 has been set in the paragraph (b) in the section (1-1) and the gate 241 is opened, and when the data in the shift register 4 is completely printed, the gate 246 is opened and the gate 248 (FIG. 3C) is opened, so that the signals ②, ⑤, ⑦ and ⑧ are obtained and are transferred from the terminal N13 to the terminal N2, whereupon the operation described in the paragraph (a) in the section (3) is repeated. This is aimed to continually perform another printing operation, such as the operation in the section (2) following the operation example "PRTV 303132V" described in the section (3).

As described in the foregoing, in the PRT mode a printing operation described in the section (2) of the data stored in the memory sections X1 and X2 or a printing operation described in the section (3) of characters based on the numerical values defined by the numeral/language character selecting key signals V are performed. Assuming that through an erroneous operation the delimitation key signal "," appears at the beginning of the input buffer 3, then it is supposed that the flip-flops 28 and F4 have been reset and therefore when the operation proceeds to the N2 routine the gate 283 (FIG. 3A) is opened after being enabled by a high signal from inverter 618 so that the signals ③ and ⑥ are obtained, whereupon the flip-flop FN4 is set and the flip-flop FN2 is reset and the operation proceeds to the N4 routine, whereby the above described input buffer 3 makes a shifting operation possible, as previously described in the preceeding paragraph (a), and the following data is obtained, while the leading delimitation key signal "," is disregarded.

Please note that the foregoing describes the loop in FIG. 4B of "N2 delimit signal judge→PRT judge→X judge→F4 judge→N2".

Although the present invention has been described and illustrated in detail, it is to be clearly understood that the same is by way of illustration and example only and is not to be taken by way of limitation, the spirit and scope of the present invention being limited only by the terms of the appended claims.

TABLE 1

| numerical value code | 1st kind characters | 2nd kind characters | numerical value code | 1st kind characters | 2nd kind characters |
|---|---|---|---|---|---|
| | | | 36 | G | ｲ |
| | | | 37 | H | ｷ |
| | | | 38 | I | ｸ |
| | | | 39 | J | ･ |
| | | | 40 | K | ｴ |
| | | | 41 | L | ｵ |
| | | | 42 | M | ｶ |
| 07 | ≧ | : | 43 | N | ｷ |
| 08 | > | ! | 44 | 0 | ｹ |
| 09 | ≠ | ; | 45 | P | ｺ |
| 10 | $ | ? | 46 | Q | ｻ |
| 11 | ) | | 47 | R | ｼ |
| 12 | ( | | 48 | S | ｽ |
| 13 | / | | 49 | T | ｾ |
| 14 | × | | 50 | U | ｰ |
| 15 | − | | 51 | V | ｿ |
| 16 | + | | 52 | W | ﾀ |
| 17 | √ | | 53 | X | ﾁ |
| 18 | | | 54 | Y | ﾂ |
| 19 | . | | 55 | Z | ﾃ |
| 20 | 0 | | 56 | ﾅ | ﾄ |
| 21 | 1 | | 57 | ▼ | ▼ |
| 22 | 2 | | 58 | setting of first kind character | resetting of second kind character |
| 23 | 3 | | 59 | ' | ･ |
| 24 | 4 | | 60 | ﾞ | ﾊ |
| 25 | 5 | | 61 | % | ﾋ |
| 26 | 6 | | 62 | β | ﾌ |
| 27 | 7 | | 63 | α | ﾍ |
| 28 | 8 | | 64 | ▪ | ｢ |
| 29 | 9 | | 65 | ■ | ｣ |
| 30 | A | | 66 | space feed | space feed |
| 31 | B | | 67 | | |
| 32 | C | | 68 | | |
| 33 | D | | 69 | | |
| 34 | E | | | | |

TABLE 1-continued

| | F | | |
|---|---|---|---|
| 70 | first digit "7" | : | print in index number indicating manner |
| | second digit | : | memory section X |
| 79 | next | | |
| | first digit | : | No. of digit of integer portion |
| | next | | |
| | second digit | : | No. of digit less significant than decimal point |
| 80 | first digit "8" | : | print in fixed decimal point indicating manner |
| | second digit | : | memory section X |
| 89 | next | | |
| | first digit | : | No. of digit of integer portion |
| | next | | |
| | second digit | : | No. of digit less significant than decimal point |
| 90 | first digit "9" | : | repetitive printing operation |
| | second digit | : | memory section X |
| 99 | next | | |
| | first digit | : | No. of digit of integer portion |
| | next | | |
| | second digit | : | No. of digit less significant than decimal point |

What is claimed is:

1. A combined electronic data processor and calculator including a character printing system for printing language character data generated in accordance with a set of numerical value key code data in a language printing mode, said language character data being represented by said set of numerical value key code data in accordance with a predetermined convention, said system comprising:

numerical value keying input means for entering selected numerical value key code data into said character printing system when in a numerical printing mode, said set of numerical value key code data including a combination of said numerical value key code data in accordance with said predetermined convention, said numerical value keying input means further entering numerical data for selective presentation to said calculator;

storage means responsive to said numerical value key code data introduced by said numerical value keying input means for sequentially storing said numerical value key code data therein, said storage means including memory means responsive to the numerical value keying input means for storing said numerical value key code data therein, said memory means developing an output signal indicative of said numerical value key code data;

function keying input means for entering selected function key code data representative of one of said printing modes into said character printing system, the numerical value key code data signal developed by said memory means in addition to said selected function key code data indicative of a selected printing mode identifying the language characters to be printed, said function keying input means including, a language kind specifying key;

language bistable latch means operatively connected to said language kind specifying key, said language bistable latch means alternating between first and second states of function key code data by repeated actuation of said language kind specifying key, said first and second states being indicative of first and second particular languages of said language characters undergoing printing;

converting means responsive to said selected function key code data and to the set of numerical value key code data for converting said numerical value key code data into said language character data of a predetermined language in accordance with said selected function key code data entered via said function keying input means;

character generating means responsive to said language character data generated by said converting means for generating said language characters to be printed in accordance with said language character data, the language characters being printed in the language determined by the language kind specifying key;

said calculator receiving said numerical data from said numerical value keying input means and performing desired calculations thereon to produce calculated results;

and printing means for printing said language characters and said calculated results.

2. A character printing system in accordance with claim 1, further comprising:

first detecting means responsive to said set of numerical value key code data for detecting a first predetermined numerical value key code data included within said set of numerical value key code data thereby defining a predetermined command included in a predetermined position of said set of numerical value key code data;

second detecting means responsive to said predetermined numerical value key code data defining said predetermined command for detecting second predetermined numerical value key code data included within the remaining portion of said set of numerical value key code data; and extracting means responsive to said predetermined numerical value key code data detected by said first and second detecting means for extracting at least a portion of said numerical value key code data stored in said storage means in a manner determined by said predetermined command of said first detecting means, said portion of said numerical value key code data stored in said storage means being determined in accordance with said second predetermined numerical value key code data detected by said second detecting means.

3. A character printing system in accordance with claim 2, further comprising:

third detecting means responsive to said set of numerical value key code data for detecting a further predetermined numerical value key code data following said remaining portion of said set of numerical value key code data defining an integer portion more significant than a decimal point and another portion less significant than the decimal point, said converting means comprising means responsive to said predetermined numerical value key code data detected by said first and third detecting means for modifying said at least a portion of said numerical value key code data extracted by said extracting means in accordance with said further predetermined numerical value key code data detected by said third detecting means.

4. A character printing system in accordance with claim 2, which further comprises:

third detecting means responsive to said set of numerical value key code data for detecting a further predetermined numerical value key code data following said remaining portion of said set of numerical value key code data thereby defining a portion of said storage means, said converting means comprising means responsive to said predetermined numerical value key code data detected by said first and third detecting means and stored in said storage means for repetitively providing said set of numerical value key code data following said remaining portion of said set of numerical value key code data a number of times equal to the contents of said portion of said storage means defined by said further predetermined numerical value key code data.

5. A character printing system in accordance with claim 1, further comprising:

first detecting means responsive to said set of numerical value key code data for detecting predetermined function key code data within said set of numerical value key code data thereby defining a predetermined command; and wherein said converting means comprises means responsive to said first detecting means for converting said set of numerical value key code data which precedes and follows said predetermined function key code data into language character data, the language character data which follows the predetermined function key code data being different from said language character data preceding said predetermined function key code data.

6. A character printing system in accordance with claim 1, wherein:

said function keying input means comprises a numeral/language character selecting key for entering numeral/language character selecting key code data, and said converting means comprises means responsive to said numeral/language character selecting key code data for converting said set of numerical value key code data into said language character data.

7. A character printing system in accordance with claim 1, wherein said function keying input means comprises a numeral/language character selecting key for entering numeral/language character selecting key code data; and wherein said converting means comprises means responsive to a first and a second actuation of said numeral/language character selecting key for converting said set of numerical value key code data entered subsequent to said first actuation and prior to said second actuation into said language character data.

8. A character printing system in accordance with claim 1, wherein said storage means comprises a memory means responsive to said numerical value keying input means for storing numerical value key code data therein, said set of numerical value key code data having a sign associated therewith, said memory means developing the stored numerical value key code data in accordance with said selected function key code data entered via said function keying input means.

9. A character printing system in accordance with claim 8 further comprising:

means responsive to the sign of said set of numerical value key code data stored in said memory means for continuously developing said set of numerical value key code data;

said printing means being responsive to the continuously developed numerical value key code data for printing corresponding ones of said language character.

10. A character printing system in accordance with claim 9 which further comprises:

disabling means responsive to said sign of said set of numerical value key code data stored in said memory means for disabling the read-out of said set of numerical value key code data from said memory means when said sign is changed and for disabling further printing by said printing means.

* * * * *